United States Patent [19]

Hornig et al.

[11] Patent Number: 4,680,578

[45] Date of Patent: Jul. 14, 1987

[54] BASELINE TRANSPOSITION AND CHARACTER SEGMENTING METHOD FOR PRINTING

[75] Inventors: Klaus-Juergen Hornig, Sulzbach; Hans-Henning Thiessen, Kelkheim, both of Fed. Rep. of Germany

[73] Assignee: Mergenthaler Linotype GmbH, Eschborn, Fed. Rep. of Germany

[21] Appl. No.: 611,563

[22] Filed: May 17, 1984

[30] Foreign Application Priority Data

May 17, 1983 [DE] Fed. Rep. of Germany ..... 3317842

[51] Int. Cl.[4] ..... G09G 1/06

[52] U.S. Cl. ..... 340/731; 340/735; 340/748; 340/790

[58] Field of Search ..... 340/723, 724, 731, 735, 340/748, 789, 790; 354/6, 7, 8, 12, 17

[56] References Cited

U.S. PATENT DOCUMENTS

| | | | |
|---|---|---|---|
| 3,568,178 | 3/1971 | Day . | |
| 3,868,672 | 2/1975 | Johnson . | |
| 3,877,007 | 4/1975 | Fishman . | |
| 3,918,040 | 11/1975 | Beuter et al. . | |
| 3,976,990 | 8/1976 | Haak . | |
| 4,199,815 | 4/1980 | Kyte . | |
| 4,254,409 | 3/1981 | Busby | 340/723 |
| 4,323,892 | 4/1982 | Kinghorn | 340/724 |
| 4,426,645 | 1/1984 | Sakai et al. | 340/724 |

FOREIGN PATENT DOCUMENTS

| | | | |
|---|---|---|---|
| 2033307 | 5/1980 | European Pat. Off. . | |
| 2091524 | 7/1982 | United Kingdom | 340/724 |

*Primary Examiner*—Gerald L. Brigance
*Assistant Examiner*—Jeffery A. Brier
*Attorney, Agent, or Firm*—Anibal Jose Cortina

[57] ABSTRACT

Characters are encoded in digital data, and this data is then used to modulate a display to image the characters. Characters are typically displayed on a display baseline which corresponds to the physical character baseline encoded in data. Where the distance of a character from its physical baseline in a first dimension exceeds the boundary limit of a display, the location of the character baseline and the display physical baseline corresponding thereto may be shifted in the opposite direction and in the same dimension in extent equal to the amount said character exceeds the display and until the character fits within the display. Alternately, where the character at its display size is larger than the display in any display dimension, the character may be segmented into parts and logical baselines inserted into each separate section. These logical baselines may be referenced to the character physical baseline relative to the distance in a first dimension therebetween. Accordingly, the logical baseline may be referenced to the character physical baseline and the display baseline to appropriately locate the character relative to the physical baseline, so that when the separate sections are reassembled on the display, the original character is reproduced.

4 Claims, 19 Drawing Figures

BASELINE TRANSPOSITION AND CHARACTER SEGMENTING METHOD FOR PRINTING

FIELD OF THE INVENTION

This invention relates to a field of phototypesetting or printing wherein alphanumeric or other characters are displayed on a screen or other light sensitive surface to form images.

BACKGROUND OF THE INVENTION

In phototypesetting, a light sensitive surface is illuminated in the shape of an image such as an alphanumeric or other character. The light sensitive surface may be the face of a CRT or may be a light sensitive sheet imaged by a laser beam or other suitable means. Such phototypesetting systems and printing systems are as shown in U.S. Pat. Nos. 4,199,815 and 4,231,096, employing a CRT and a laser beam respectively. Where characters are imaged in varying sizes, the size of the character is limited by the size of the CRT screen or the range of the light sensitive sheet over which a beam such as a laser may be directed, or generally, in the case where these or other imaging means are used, the physical area over which the imaging means is constrained physically. In such cases, the size of the character capable of being displayed is limited by the size of the imaging area. Where larger sized characters are to be imaged, then the size, cost and complexity of the system must be increased accordingly to accommodate those larger sized characters.

SUMMARY OF THE INVENTION

According to the principals of this invention, characters or other shapes to be projected on a limited image area such as a CRT face or the imaging area covered by an imaging beam or other similar device are compared in size to the size of the imaging area.

The system in which the inventive principles are used, contains an encoded character which is encoded at a master size for display at a variable size which may be larger or smaller than the master encoded size and larger and small than the display. However, it should be understood that this invention can be used with a character which is encoded at a single size for display at that single size and where a change in the screen resolution, for example, may cause the characters, when projected to be larger or smaller than the relative encoded size. The characters are encoded with a character physical baseline. As is usually done, the character physical baseline is referenced to or aligned with a display physical baseline location and which typically corresponds to the baseline of a text appearing on an imaging surface. As is usually the case in printing and typesetting, the character physical baseline is projected on the imaging surface to coincide with the text physical baseline. The display may be thought of as an imaging window through which a writing means causes the encoded character to be displayed at its desired display size and relative to a display physical baseline location which serves as a reference for locating the encoded character physical baseline. Because it is more efficient to have a limited size display window and to move an imaging surface past the display window introducing fresh areas for projection of the displayed character on the imaging surface, the display physical baseline is referenced to its projected image location on the imaging surface, as is known in the art. The display, according to the preferred embodiment, is a CRT with an imaging surface movable past the face of the CRT in the direction of a first dimension. However, the display may also be a laser beam having a limited displacement or angular range in a first dimension and which displays the character and projects the character onto an imaging surface in a manner similar to the CRT beam, but without the intermediate imaging surface of the CRT beam.

According to the principles of the invention, a character when displayed is referenced to a display location by referencing the character physical baseline to a display physical baseline. In the case of a laser beam, it would be a location measured by the angular deflection of the laser beam. In the case of a CRT, it would be a location on the face of the CRT imaging surface. Where the encoded character at its display size is indicated as being larger than the display so it is impossible to image the whole character within the display window, then it would be necessary to either move the character in the direction of the dimension it extended beyond the borders of the display, thereby to move the character back into the display window. This relative movement of character to display window may be accomplished by moving the character physical baseline so its location on the display physical baseline causes the aforesaid relative movement or by moving the display physical baseline and the character physical baseline referenced to it thereby bringing the character back into the display window when it is again located in correspondence with the display physical baseline. The character may be then displayed within the borders of the display window and then imaged on the movable surface.

Additionally, characters having the said display physical baseline may be grouped and displayed and imaged as a group prior to and subsequent to the display and imaging of groups preceding and subsequent in the said order. When the display writing means is at the limit of its display range or window, and the movement of the display physical baseline relative to the character physical baseline is no longer useful to bring a character within the full dimension of the display, then the imaging surface can be moved relative thereto and the display means can be reset to reimage characters in successive groupings. This will be necessary where the image locations of the display physical baselines associated with the characters when projected on the imaging surface or outside the range of the display means.

Further, according to the principles of the invention, where a character encoded in the master size is to be displayed at a size larger than the screen the character may be sectioned into encoded separate sections. Logical baselines may be inserted in those encoded separate sections and then those logical baselines reference to a display physical baseline and location and to an image locate corresponding to the display physical baseline for the encoded logic sections. In this case, the logical baselines are referenced to the encoded character physical baseline and to a respective display physical baseline. The respective display physical baseline for the logical baselines are referenced to their corresponding projected location on an imaging surface. The encoded separate sections then are projected on the imaging surface, by the display at locations spaced from the projected image location of the character physical baseline, and related to the encoded spacing between the logical baselines and the encoded character physical baseline so that the characters are accurately reproduced.

Additionally, encoded characters can be grouped by the location of their respective display physical baselines on the imaging surface and ordered according to their respective locations and then displayed and imaged in groups according to that order.

In imaging master characters typically, the physical baseline or text baseline of the characters on the imaging area is defined and then the physical extent of the characters from the baseline is compared to the extremes of the imaging area border. Where the size of all characters is such that when located on the physical baseline all the characters fit within the image area, then no adjustment is necessary. Additionally, where the characters are relatively small such that more than one or a series of text lines can fit on the screen, then such text lines may be imaged in one pass requiring no adjustment of the imaging surface relative to the screen.

Where a range of character sizes are reproduced from a master size stored character or from a single stored size, a size will be reached where the imaged character will be so large that it cannot be accommodated on the screen.

As the cost and complexity of the screen and associated circuitry is increased with an increasing imaging surface size, a direct benefit is realized by limiting the size of the surface and reproducing characters larger than the predetermined image surface dimensions, according to the principles of the invention disclosed herein. Where the characters located on an imaging surface's physical baseline, corresponding, for example, to the text baseline, extend beyond the limits of the predetermined size of the image surface, then the surface's physical baseline may be shifted, thereby shifting or displacing the character on the image surface therewith to accommodate the whole character in one imaging pass. This may be accomplished, for example, in the case of a capital "A" by relatively displacing the display physical baseline on the image surface downwardly. If an imaging beam is used such as a laser or a CRT, and part of the character was outside the imaging area of the beam or the CRT, then accordingly the imaging surface would be moved to locate the physical baseline location on the imaging surface within the range of the imaging beam. If the character, for example, had a descender extending beyond the bottom of the screen, the character physical baseline can be moved thereby altering the juxtaposition of the character to the display physical baseline and moving the character within the display.

If a character, projected on a CRT screen, or by a beam on an image surface, is larger than the available screen or surface area, then according to the principles of the invention, the character is segmented and imaged in at least two passes depending upon the size of the character. Where a character is naturally separated by a gap such as the case of an accent, the character may be segmented between the accent and the character, with the accent imaged separately from the character. In the similar case of a lowercase character divided in two parts, such as a "j" or an "i", the character may be conveniently segmented at the gap between the dot portion and the lower body portion. Where a one-piece character is so large it cannot be accommodated on the available surface, then it may be segmented at any convenient location. For lowercase characters such as "o" or "e" without descenders below the text baseline or ascenders extending beyond the lowercase upper border, such as for "h", the character may be conveniently cut in the middle. Where the character has descenders, it may be conveniently cut at the location where it would ordinarily rest on the text baseline. For ascenders, such as "h" or "b", the character may be cut where it extends beyond the lowercase border. Other characters may be cut by referencing the physical baseline on the surface to the text baseline and segmenting the character where it intersects with the border of the screen. For example, if brackets ([ ]) referenced to the physical baseline (text baseline) extended beyond the borders of the screen, the system could segment the brackets at its intersections with the screen border.

In accordance with established typesetting practice and printing, a character is referenced to an EM square and its size defined by the EM square size. The principles of the invention are described with reference to the EM square as the character is defined on a grid within the EM square and on an EM square baseline. However, it should clearly be understood the invention is not limited to the case of a character defined within an EM square and could be applied to characters defined by other references. In the case of the preferred embodiment, the defined EM square grid is 24 units along the vertical dimension of the EM square, from top to bottom, with regard to the accepted orientation of characters. The physical baseline is located 18 units from the EM square top. The area for descenders is located between 18 units from the top and 22 units from the top, with an extension area for long descenders located at the bottom two units of the 24 unit EM square (or from 22 units from the top to the bottom 24 units of the EM square). The area for lower case letters being the middle area, is located from 8 units from the top to 14 units from the top, with the bottom of the middle area coinciding with the baseline, and the top of the middle area coinciding with the lowercase border. An uppercase area is provided in the EM square, extending 14 units and starting 4 units from the top and extending to the baseline at the 18 unit point. An extension area for ascenders is located with the bottom of such extension area coinciding with the uppercase border 4 units from the top of the EM square, the top being the 0 unit. Where characters are so large that they require segmenting in two or more pieces, then convenient segmenting locations may be chosen accordingly.

Each of the characters may be referenced to a location in a stored look-up table which may carry the character identification such as the character number, and its position in its EM square relative to the dimensions therein and as, for example, described above. The look-up table may be used to determine whether the character at its desired size will fit on the surface relative to the physical or text baseline, whether to shift the baseline or to segment the character and the locations within the EM square position relative to the character, for segmenting the character.

Accordingly, it is an object of this invention to provide a method and system for utilizing the full projection area of an imaging surface to project characters of a size extending beyond the borders of the surface.

It is a further object of this invention to provide a system and method for segmenting characters as necessary to project the characters on the screen in separate parts.

It is a further object of this invention to provide a system and method for identifying one or more such segmenting positions in the character relative to imaged character size.

These and other objects will become apparent in the following detailed description of the invention.

DESCRIPTION OF THE PREFERRED EMBODIMENT

Figure 1:
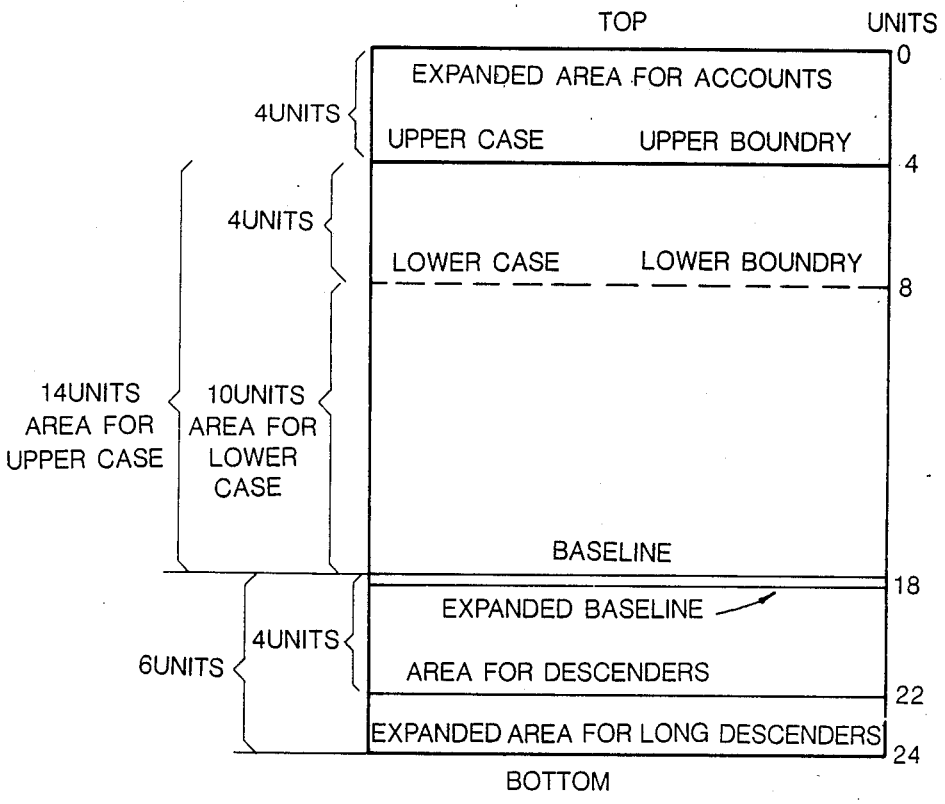
FIG. 1 shows an EM square, divided into 24 units, whose size defines the size of the character set within the EM square.

FIG. 1 shows an EM square used in typesetting and printing to define or provide a reference for a character. This concept does not form part of the invention but is used as part of the explanation of the inventive principles herein. The EM square as used in the preferred embodiment contains a grid and is shown as having 24 units from Top to Bottom. The EM square character physical baseline is located 18 units from the top and 6 units from the bottom. The Em square character physical baseline is the conventional location for referencing the character. Some characters, for example, lowercase "j" and "g", contain descenders which project below the baseline into the Area for Descenders shown as located from 18 units to 22 units from the EM square top in FIG. 1. An Extension Area for Long Descenders is also provided in the bottom two units of the EM square. The Area for Lowercase letters is shown extending from 8 units from the Top to the baseline. A Lowercase Border, located 8 units from the Top separates the Area for Lowercases from the Area for Uppercases. For some characters, such as lowercase "h" and lowercase "b", and lowercase "t", part of the characters will extend above the Lowercase Border into the Area for Uppercases. Other characters which may extend above the Lowercase Border are lowercase "1", lowercase "d" and lowercase "f". An Extension Area for Accents is provided from the Top of the EM square, (0 unit level), to 4 units from the Top. This area is typically used to locate accents relative to the character. As conventional in typesetting and printing, the characters defined within the EM square are encoded in digital data. That data is then used to modulate a display and to set the characters on a text baseline relative to each other and with reference to the location of each character within its individual EM square. As shown in the aforementioned patents, an encoded normalized character set on a 24 unit grid may be projected onto a screen at different sizes. In such a case, the 24 EM square grid units may be expanded to a much higher resolution such as, for example, 432 vertical by 432 horizontal units.

As stated above, the EM square is not part of the inventive principles, but it does offer a convenient reference for locating a character relative to its character physical baseline encoded in the encoded character data and for identifying one or more logical baselines in the character when the character is segmented.

For the purpose of explanation, the imaging means is assumed to be a CRT screen or display which forms an image. The image is then projected on an image surface. The display physical baseline is then used as a reference location for the CRT imaging means. In a similar manner and as known in the art, any other imaging means used, such as a light source projecting an image directly on a surface, will be referenced directly to the physical baseline on the surface. In the case of the CRT or any other imaging means forming an intermediate image, the display physical baseline on the intermediate imaging means would be referenced relative to the baseline on the final imaging means, as is known in the art.

Figure 2:
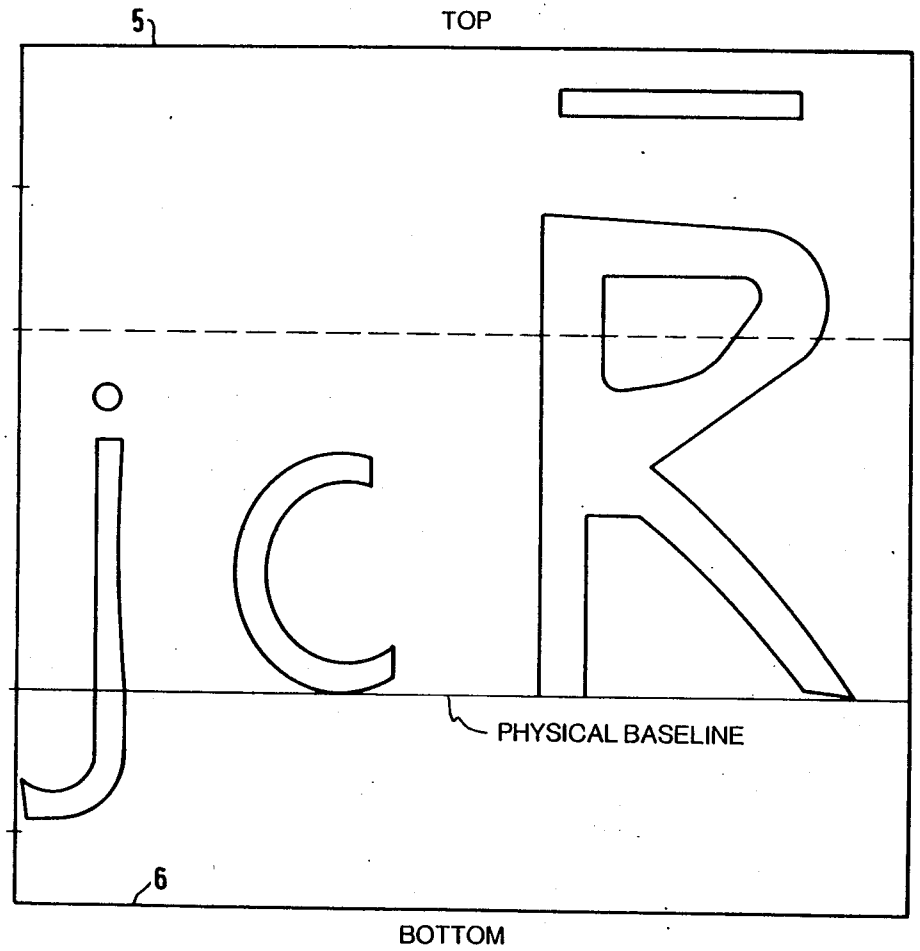
FIG. 2 shows a number of characters of difference sizes referenced to a display of 18 milimeters.

Referring to FIG. 2, an example of a CRT screen is shown having a total vertical dimension of 18 mm. For the purpose of explanation, the 24 unit EM square shown in FIG. 1, may be thought of as projected to on the 18 mm. screen, so that the 18 mm. vertical direction corresponds to the 24 units of the EM square. A character encoded in the 24 unit grid would then fill the screen when the EM square defining the character is approximately 51 points or 18 mm. in height (51 points=18 mm. divided by 0.351 mm. per point). As is understood, the character itself defined within the EM square typically would be less then 18 mm. As can be seen from FIG. 2, whereas in the preferred embodiment, the physical baseline in the encoded EM square corresponds to the location of the physical baseline on the screen, and where none of the characters exceed the imaging surface's vertical dimension from the baseline to its Top 5 and none of the characters have descenders which extend beyond the Bottom 6 of the surface, all of the characters may be accommodated on the screen and no shift of the physical baseline on the screen or segmenting is necessary.

Figure 3:
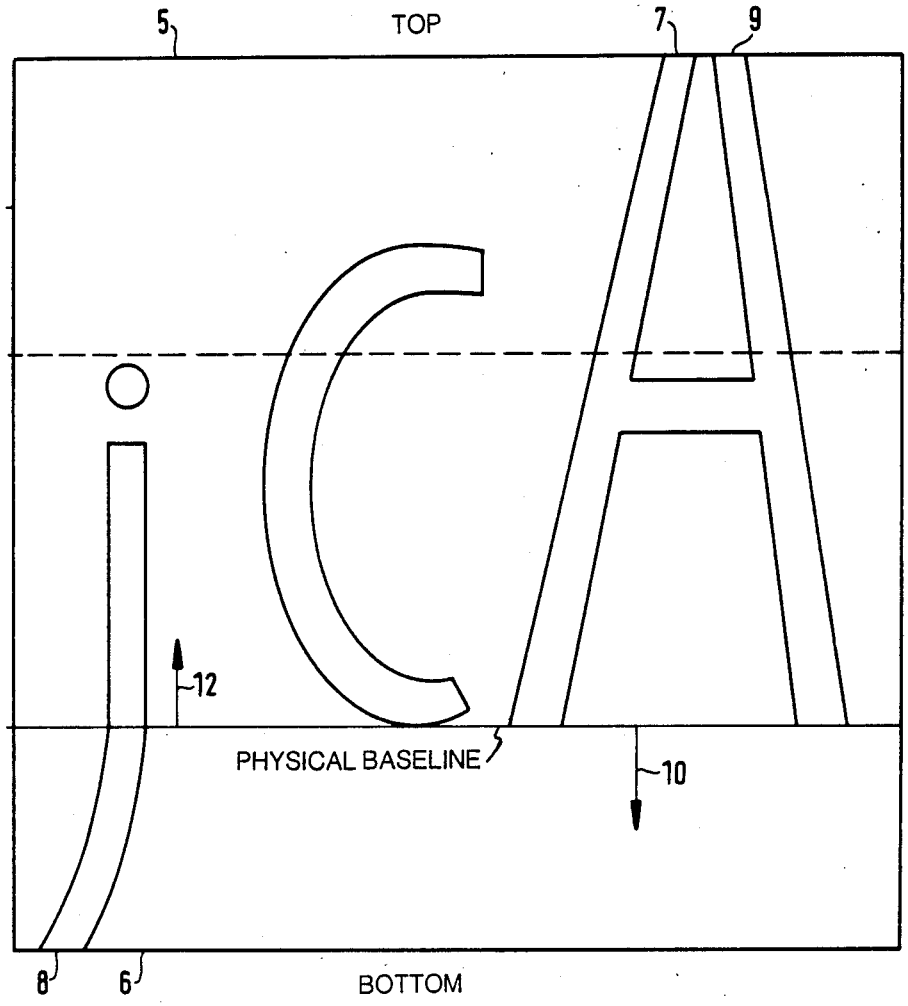
FIG. 3 shows characters at a larger size than the display of FIG. 2 and with the characters exceeding the display in a first dimension.

The characters projected on the screen may be increased in size by specifying a displayed EM square size larger than 51 points such that only the lowercase letters are less than the surface size and can be accommodated with the surface boundaries. For example, in FIG. 3, the lowercase "c" is shown on the physical baseline within the Top 5 and Bottom 6 of the screen, while the capital "A" extends over the Top 5 at locations 7 and 9 and the descender portion of the "j" extends over the Bottom boundary 6 at location 8.

When projecting the oversize "j" on the screen, the physical baseline on the screen may be displaced vertically in the direction of arrow 12, sufficiently to bring the bottom portion of the "j" within the Bottom 6 of the screen. Similarly, the physical baseline of the A may be displaced downwardly in direction of arrow 10 to bring the top portion of the "A" within the Top 5 of the screen. Displacement of the physical baseline either in the direction of arrow 10 or 12 will bring the character into full view on the screen until the size becomes larger than the available screen size. Where the screen size is 18 mm., the maximum size character that can be accommodated is 18 mm.

Figure 4:
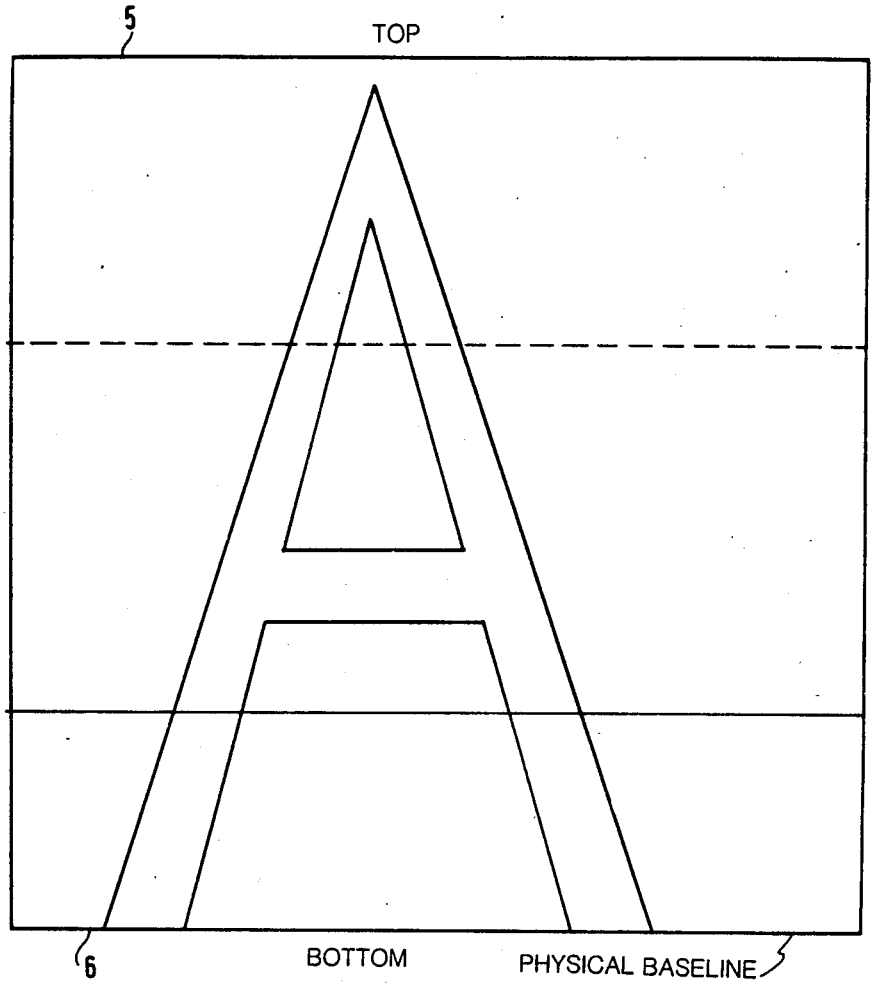
FIG. 4 shows how the "A" of FIG. 3 and in particular, the character physical baseline of the A in FIG. 3 can be shifted on the display corresponding to the extent a part of the A exceeds the display boundry.
Figure 4A:
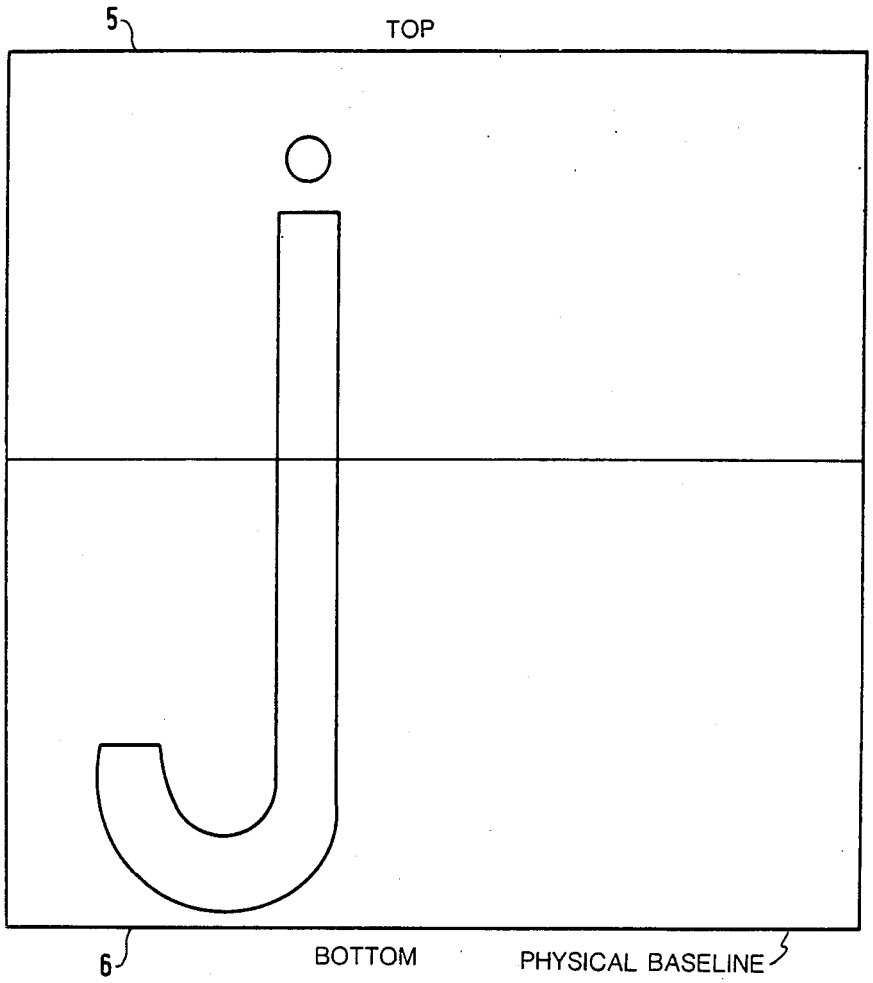
FIG. 4*a* shows how the physical baseline of a oversize character such as a J, can be shifted to the extent it exceeds the display boundry, to locate the character fully on the screen.

The maximum imaged size of the character may be shown for example by FIG. 4 wherein the "A" is projected to the maximum size of the screen and with the physical baseline for the "A" being referenced at the Bottom 6 of the screen. In FIG. 4*a* is shown the "j" wherein the physical baseline is displaced upwardly so the full size of the "j" including the dot portion may be displayed on the screen.

Where an intermediate imaging surface is used in conjunction with a final imaging surface, such as a CRT screen with a film, the screen physical baseline and the imaging surface must be moved relative to each other to maintain the screen baseline with the imaging surface baseline in alignment.

Figure 5:
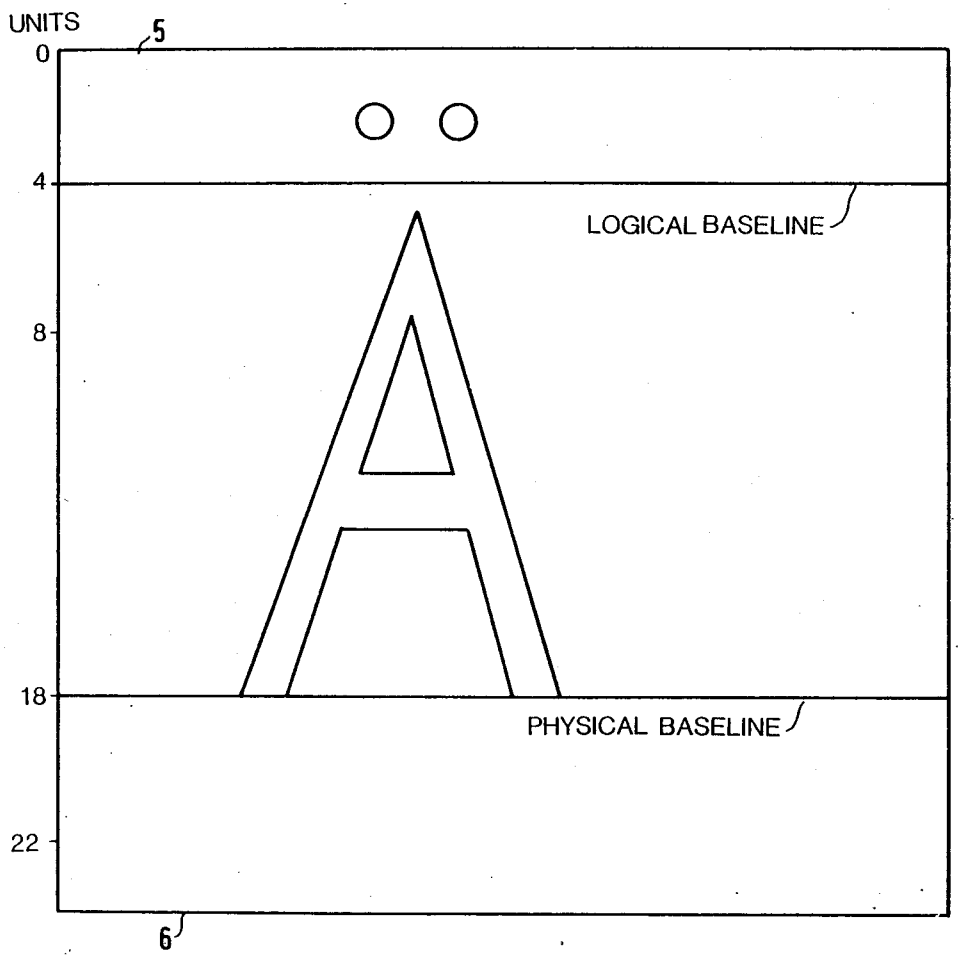
FIG. 5 shows how a character larger than the display may be segmented by inserting a logical baseline in the character.
Figure 5A:
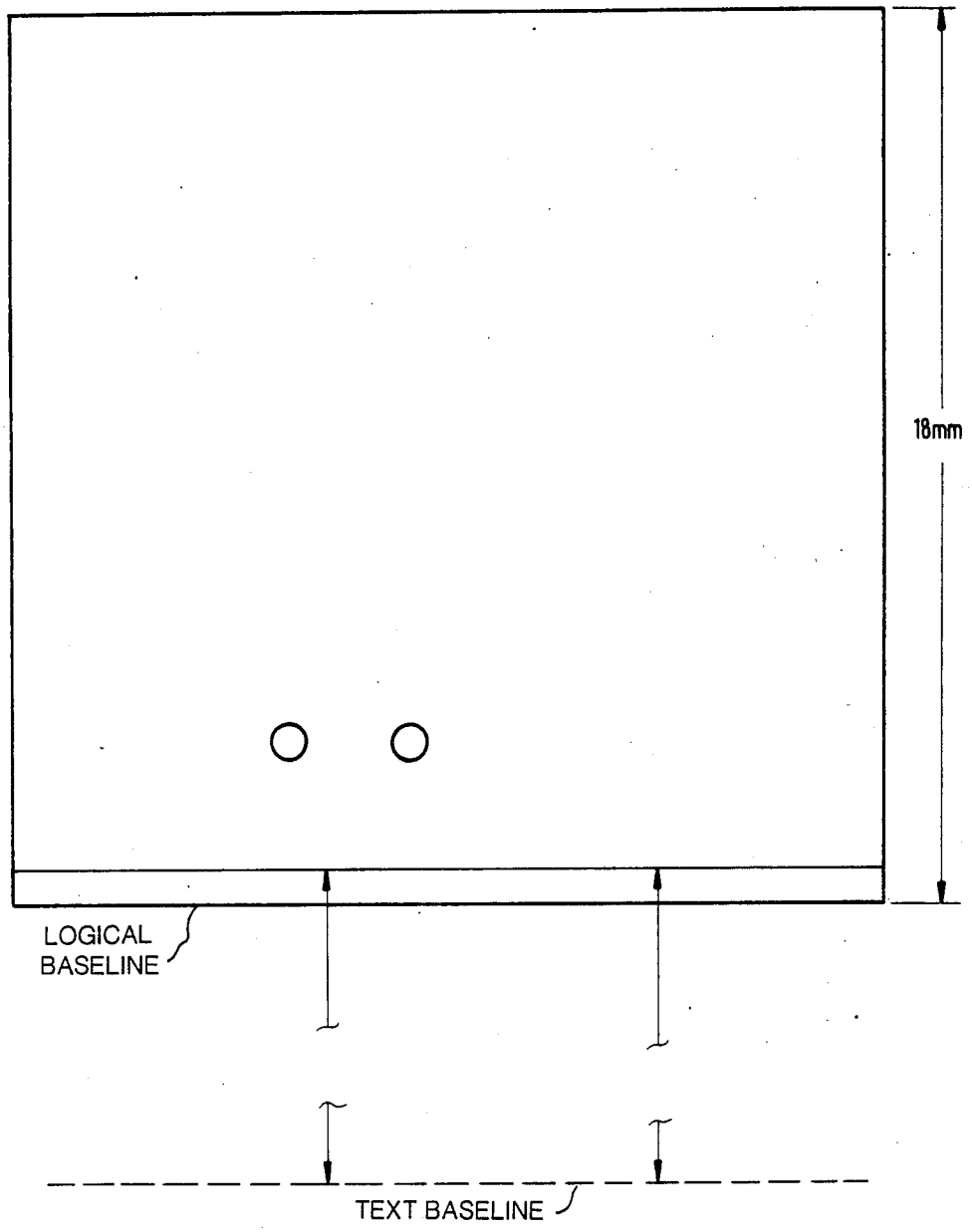
Figure 5B:
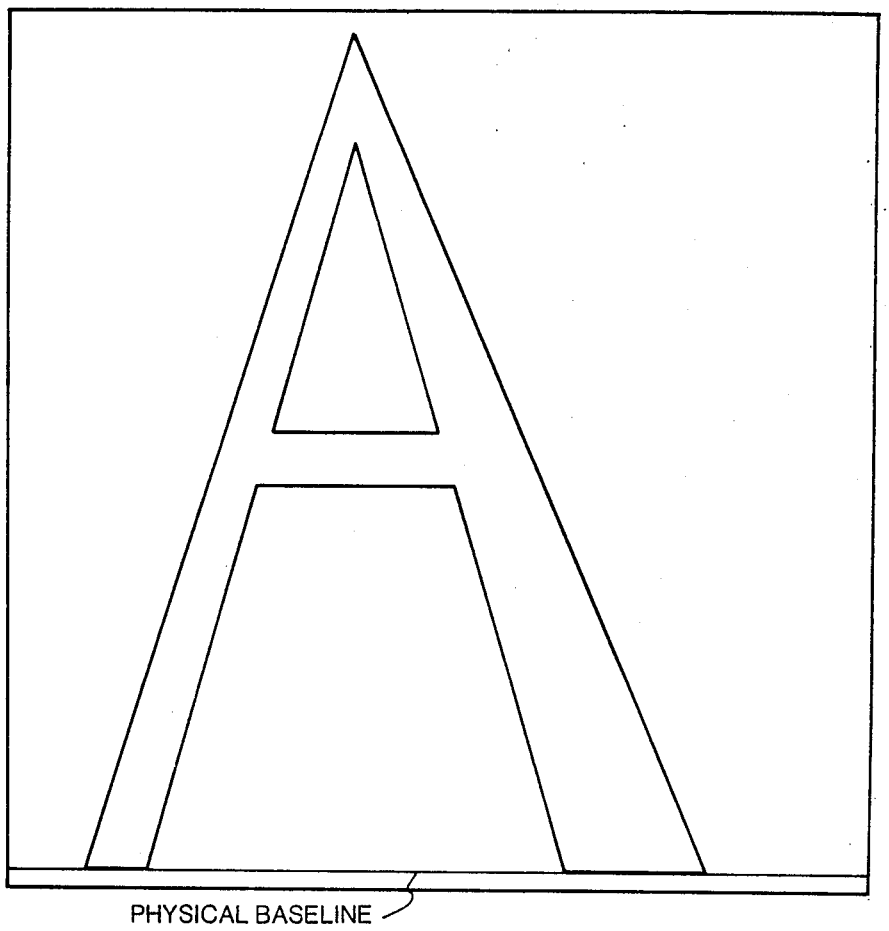

Referring now to FIGS. 5–14, it may be seen how a character may be segmented where the size of the imaged character on the screen is larger than the screen. In the case of a characters such as that shown in the EM square of FIG. 5, having a natural gap, as between the accent and the character, the character may be separated at the gap by projecting a new logical baseline for the accent and then referencing that logical baseline to the screen as shown in FIG. 5*a*. The imaging surface then would be shifted relative to the accent to locate the physical baseline of the text on the imaging surface in correspondence to the accent and at the proper location relative to the logical baseline of the accent. When imaged, the logical baseline on the screen may be located on the screen and relative to the physical baseline on the surface in any suitable relationship. Where the remaining portion of the character such as the "A" shown in FIG. 5 is large enough to be accommodated on the screen, then its screen physical baseline may be located as necessary to accommodate the character at its designated size as shown in FIG. 5*b*. The character may be imaged in two passes, first imaging the accent and then relatively shifting the imaging surface and imaging the remainder of the character.

As shown above, characters larger than the total vertical dimension of the screen, given in the preferred embodiment as 18 mm., could be accommodated by segmenting the characters and imaging the characters in parts, and as shown in FIGS. 5, 5*a* and 5*b* by relatively shifting the baseline on the imaging surface to locate it in correspondence to the character and baseline on the screen. A character need not be segmented unless its displayed size is larger than the maximum size of the screen. For example, if the maximum size of the screen, is 18 mm., as shown, then any character larger than 18 mm. would be segmented. When segmented, a logical baseline is added to the character. In addition to the physical baseline, the logical baseline may be viewed as a reference location on the character for locating the segmented character parts at their proper locations relative to the baseline on the screen and imaging surface.

Figure 6:
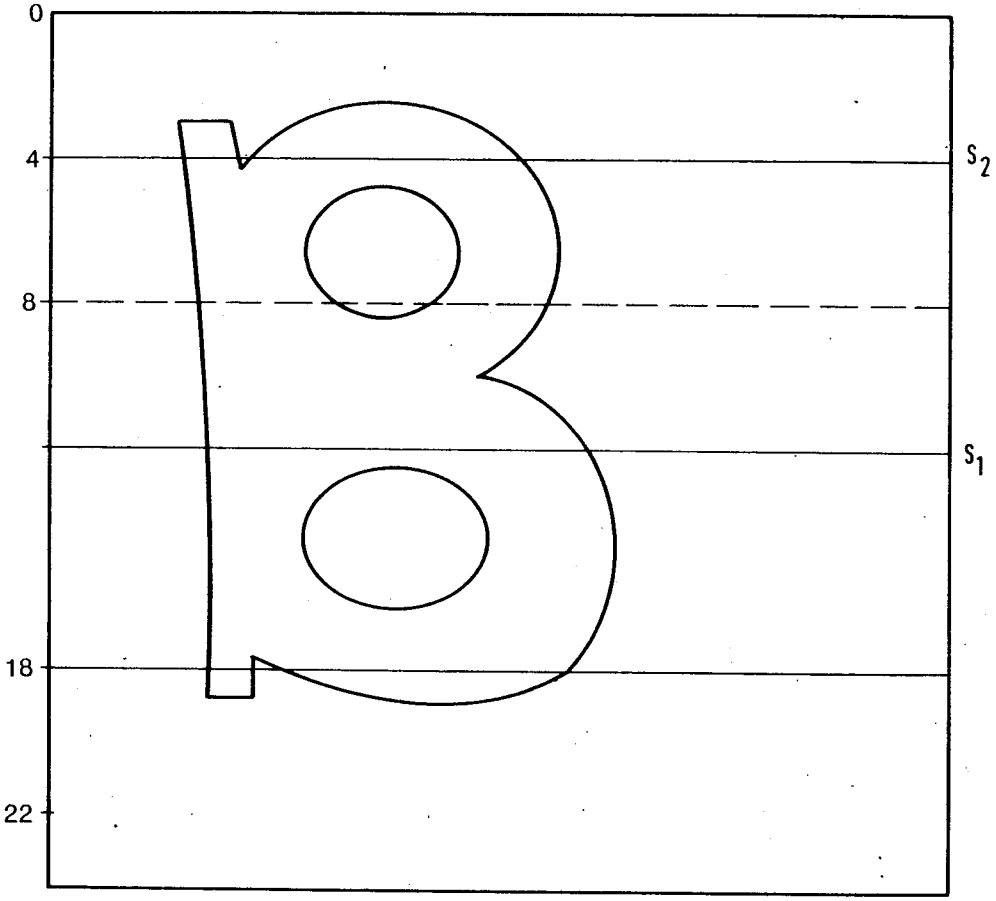
FIGS. 6–7 show how other characters may be segmented as is done in accordance with FIG. 5.
Figure 6A:
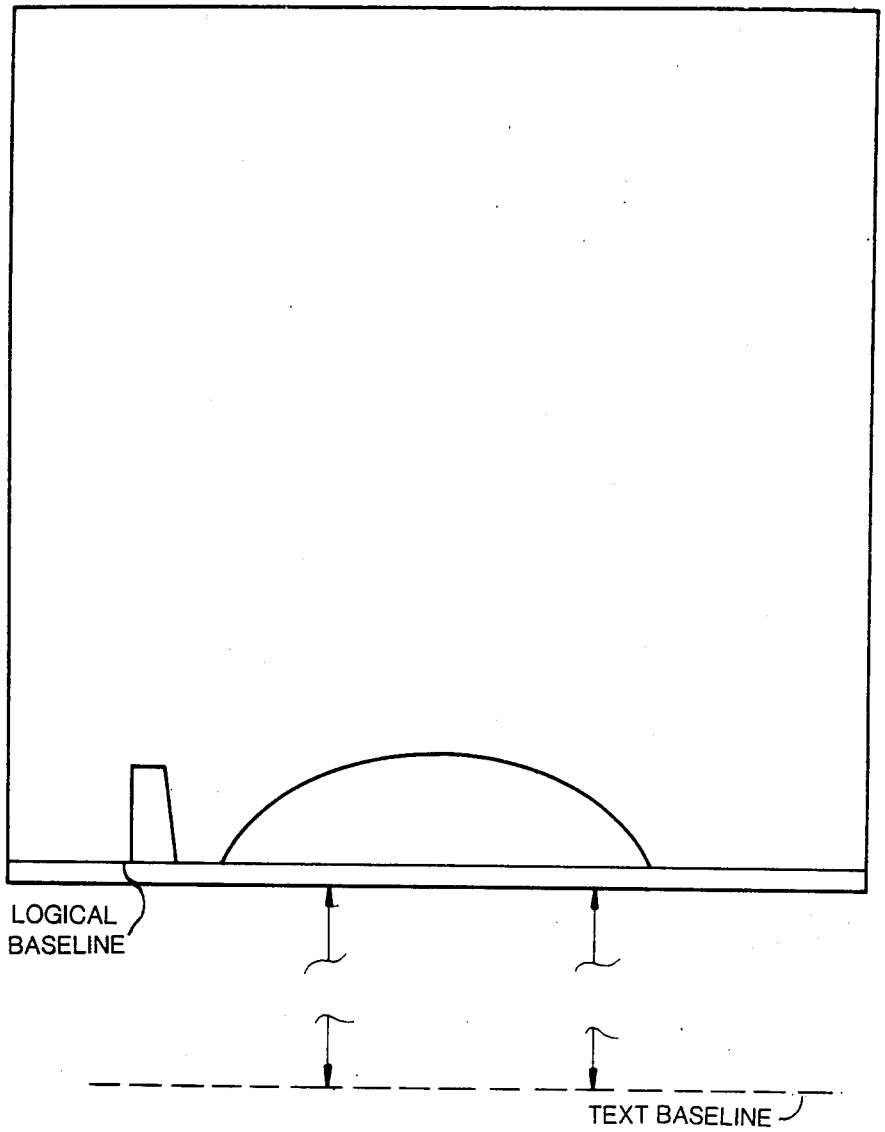
Figure 6B:
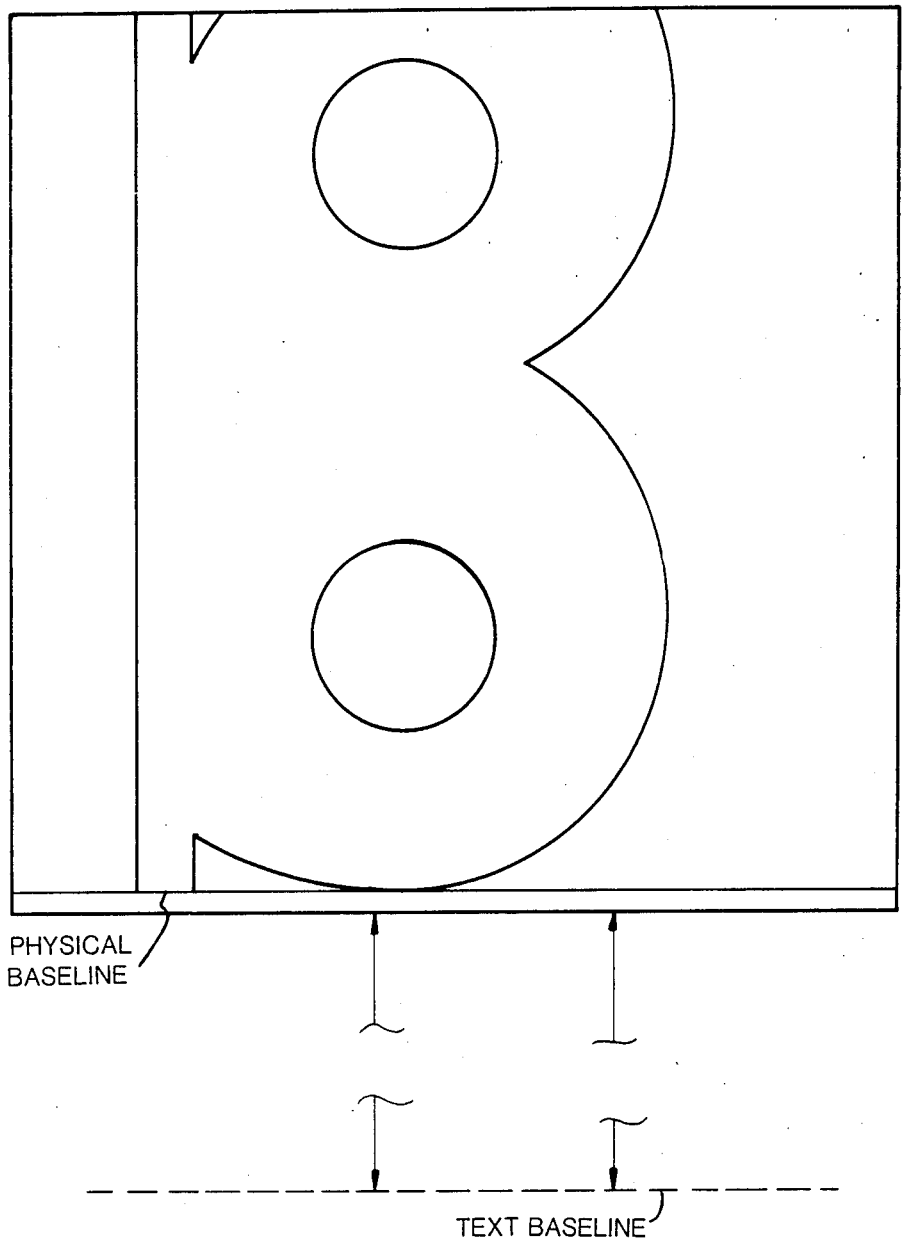
Figure 7:
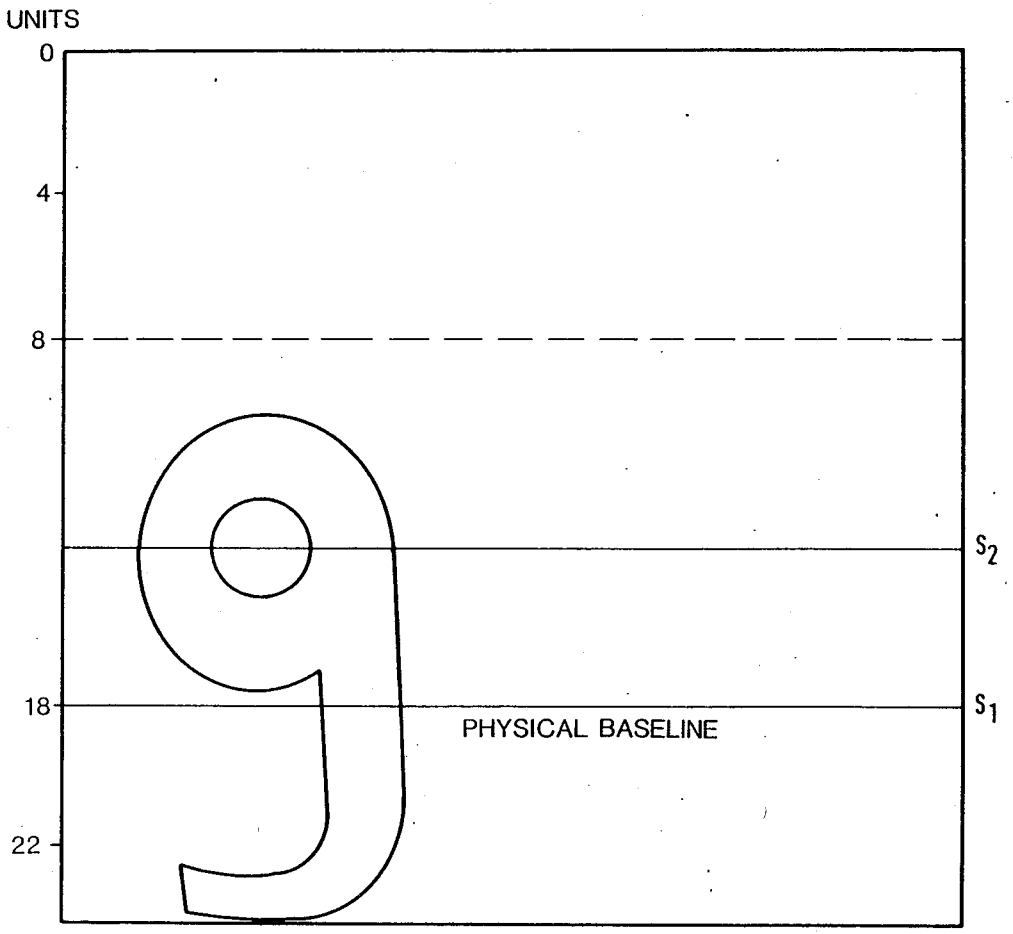
Figure 7A:
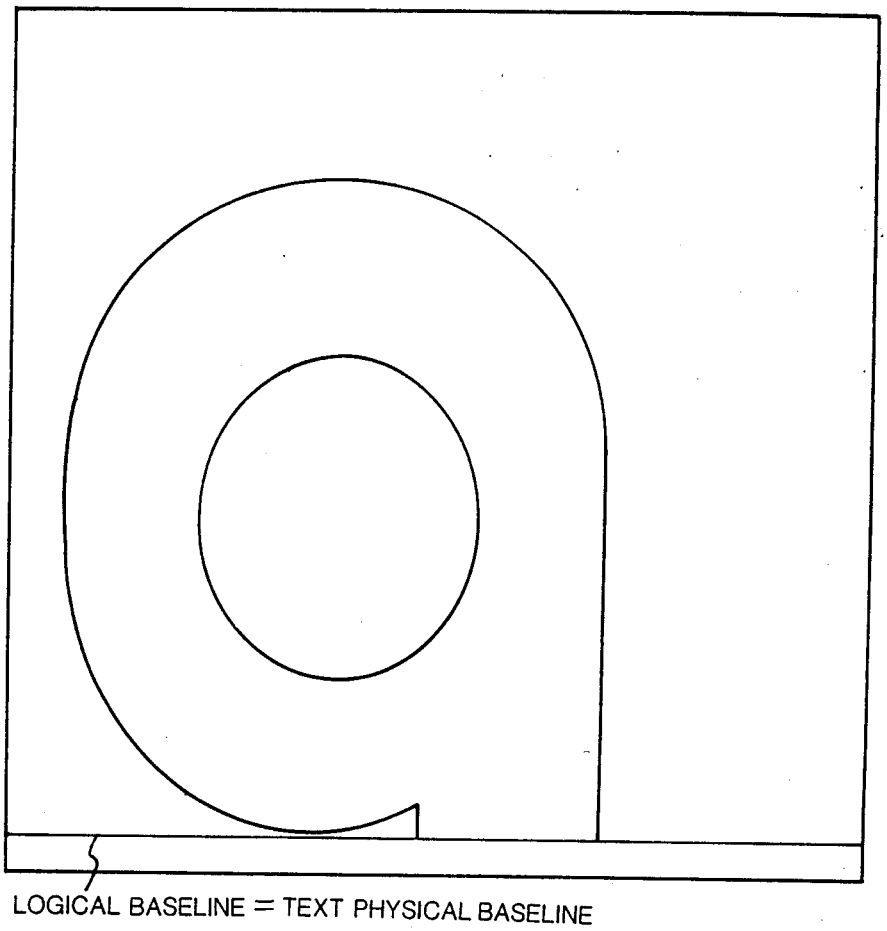
Figure 7B:
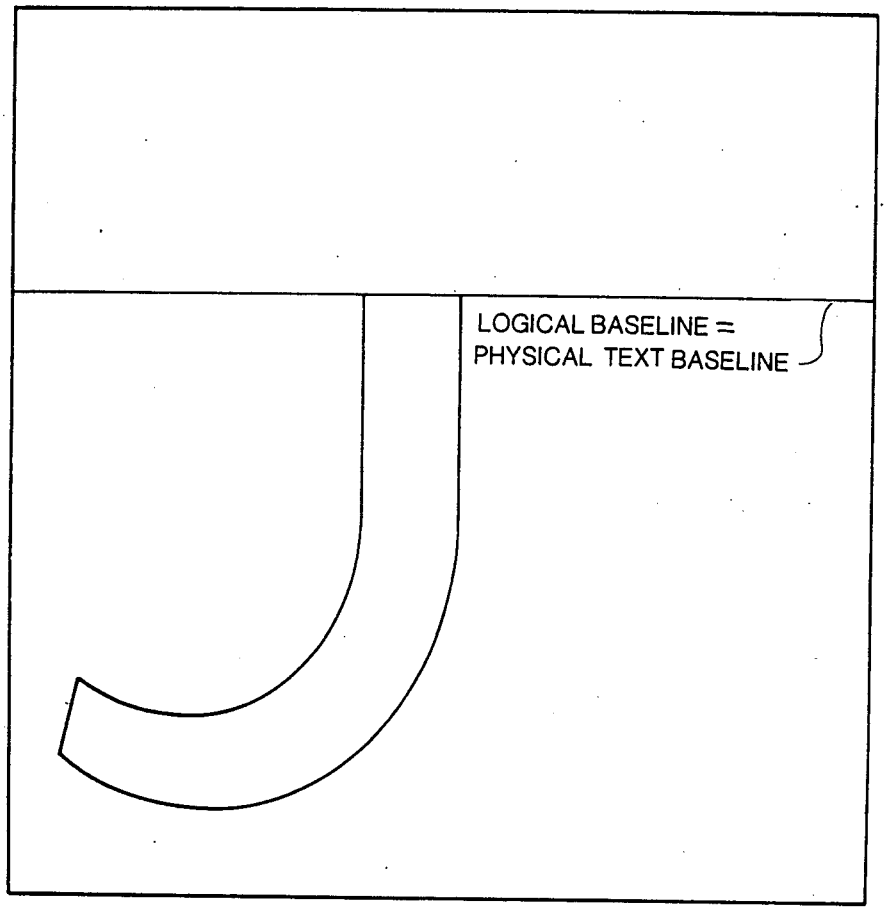

Further examples of segmenting the character may be seen in FIGS. 6, 6*a* and 6*b* wherein the character is shown defined within the EM square and extending from the Area for Descenders (18 to 22 units) into the Extension Area for Accents (0 to 4 units). A character such as the uppercase "B", when displayed at a size larger than the available screen size may be imaged in two or more steps, depending upon the point size and with the imaging surface shifted to bring the image surface physical baseline into alignment with the logical baseline relative to the screen. In the case shown in FIG. 6*a* where the upper portion of the "B" is displayed, the text image baseline on the image surface is displaced from the logical base-line a distance equal to the remaining part of the character opposite the segmenting line S2. As can be understood, the image surface physical baseline corresponding to the text baseline would be located at some point below the screen as shown by, for example, the dash line. In a first pass, the part of the "B" above the segment line S2 would be imaged. In a subsequent pass, as shown in FIG. 6*b*, the bottom portion of the character "B" extending from the segment line S2 would be imaged.

Where a character has descenders as shown by the lowercase "g" shown with an EM square in FIG. 7, the character may be segmented where the character intersects with the physical baseline, shown by S1, and then imaged relative to the physical baseline or text baseline on the screen in a similar manner as that explained above. In this case, the logical baseline would correspond to the physical baseline. In a first pass, the part of the character above the segment line S1 is imaged relative to the text baseline on the imaging surface as shown in FIG. 7*a*. In a subsequent pass, the relative position of the imaging surface may be adjusted upwardly to locate the image surface physical baseline in correspondence to the logical baseline, so the character is imaged opposite the appropriate location on the imaging surface, as shown in FIG. 7*b*.

FIGS. 8, 8*a*, 8*b* and 8*c* illustrate how the imaging means such as the CRT screen may be displaced, relative to the imaging surface to form successive portions of the characters in successive passes. The relative vertical dimension of a CRT is shown therein. To illustrate the principles of the invention, a series of characters are shown imaged in the same series of sequential scans. It should be understood that each character can be separately imaged and completed prior to the imaging of any other character and that the CRT screen may be placed in any location relative to the imaging surface. Further, the physical baseline on the CRT screen may take different locations relative to the text baseline. However, as it will be understood by those skilled in the art, the portion of the character selected for imaging, will be related to the location of the CRT screen and the physical baseline on the CRT screen will be located relative to the text baseline. Also as will be understood by those skilled in the art, either the CRT screen may be displaced and the imaging surface held stationary or the imaging surface may be displaced and the CRT screen or other imaging means held stationary. In the preferred embodiment, the CRT screen is held stationary and the imaging surface is moved relative thereto.

Figure 8:
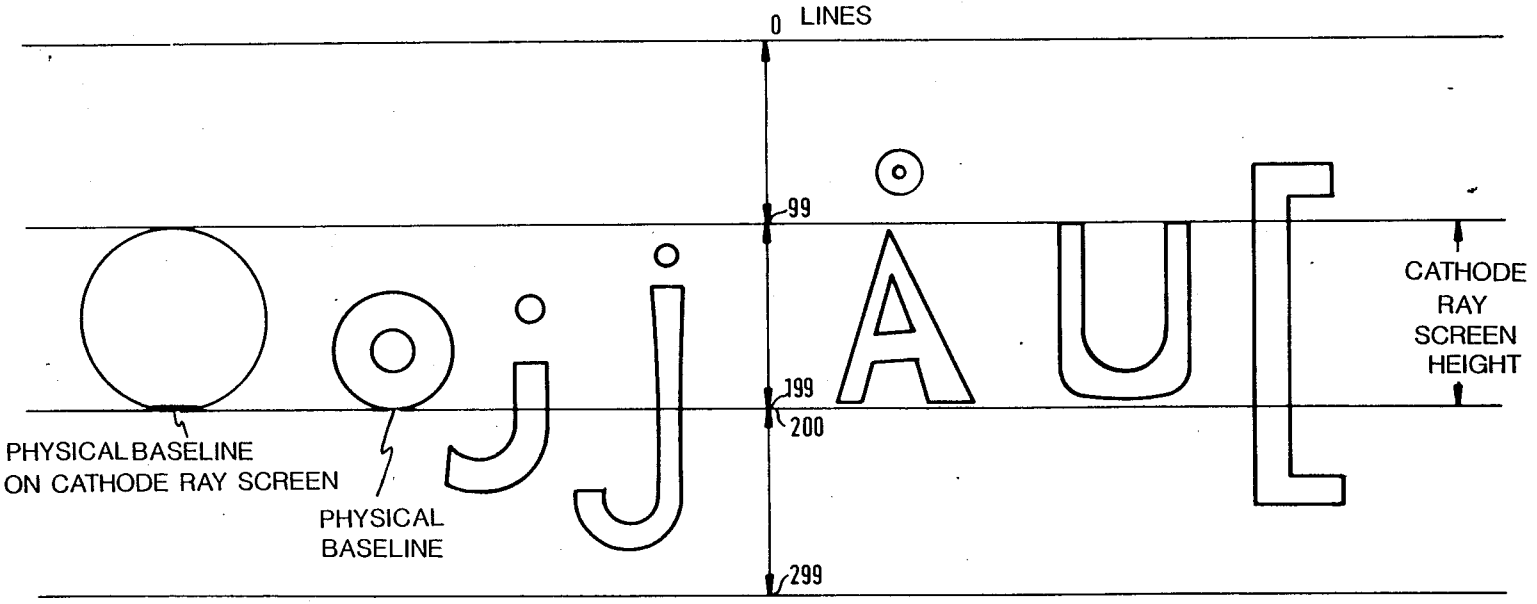
FIGS. 8, and 8*a* and 8*b* show how characters may be segmented, logical baselines inserted and characters having the same logical baseline displacement from the character physical baseline imaged in the same pass or as a group, prior to the imaging of other groups of characters having the same respective logical baseline displacement from the character physical baseline.

As shown in FIG. 8, the CRT is oriented with its physical baseline corresponding to the Text Baseline. With the given dimensions of the CRT screen available for imaging as shown in FIG. 8, it can be seen that lowercase "o", uppercase "A", and uppercase "U", can be fully imaged in one pass. The accent above the upper case "A", the small lowercase "j" and the larger lowercase "j" and the "[" will require a succession of passes. However, it should be understood that with the CRT screen and its physical baseline oriented differently with regard to the Text Baseline, and with regard to each individual character, for example, it would be possible to image in one pass lowercase "o", and the smaller lowercase "j". However, that process would require more separate increments of the imaging surface relative to the CRT or imaging means. In the example shown, the characters in FIG. 8 are imaged in three passes, it being understood that the number of passes may be varied as well as the orientation of the characters on the CRT physical baseline and the segmenting for the characters according to the principles of the invention.

Figure 8A:
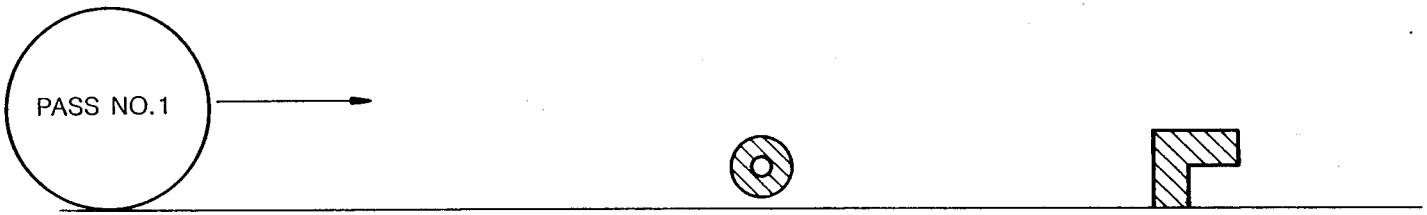

As shown in the preferred embodiment, the accent and the upper portion of the "[" is imaged on a first pass as shown in FIG. 8*a*. The imaging surface is then moved relative to the CRT screen, a distance equal to the vertical dimension of the imaging surface and in pass number two, the lowercase "o", the dot on the larger lowercase "j", the capital "A", the captial "U" and the middle portion of the "[" are imaged. In a third pass, the imaging surface is moved half the vertical distance of the CRT screen and the remaining portion of the larger lowercase "j" is imaged and the full portion of the lowercase "j" is imaged.

As can be seen, the lowercase "o" may be imaged on the CRT face with using less than the full vertical dimension of the CRT imaging means. The uppercase "A" and the uppercase "U" are of a size that requires the full vertical dimension of the CRT screen.

Further, as may be seen with the given orientation of the CRT screen baseline relative to the text baseline, it is necessary to segment the "A" accent and the larger lowercase "j" at their respective gaps imaging the accent first in the first pass and the dot of the larger lowercase "j" in the second pass. Then, the remaining portion of the "A" accent opposite the gap may be imaged on the second pass while the remaining portion of the larger lowercase "j" on the other side of the gap may be imaged on the third pass.

The "[" is shown imaged in three passes. Since the "[" has no natural gaps upon which it may be segmented, the "[" is shown segmented at the text baseline location and at a second location separated from the first segmenting point by the vertical dimension of the imaging means.

As the small lowercase "j" fits within the CRT beam, it may be imaged in one pass, namely the third pass upon incrementing the imaging means relative to the imaging surface one-half the distance of the vertical dimension of the imaging means.

As previously explained, characters are defined within an EM square. The EM square is related to the point size of the characters, the point size being the size of the M square. For example, where a point is the equivalent to 0.351 mm., the 18 mm. would be an EM square of 51 points. However, as is known in typesetting and printing, a character defined within an EM is smaller than the given EM square. For example, where the EM square is defined in a 24 unit grid and where the 24 unit grid is assumed to be equal to a 51 point EM square or 18 mm., then a character of 18 units within a 24 unit grid of the 51 point EM square would correspond to 13 point mm. on the screen. Disregarding the EM square size and concentrating on the size of the character, unrelated to the EM square, that same size character can be projected upon the full 18 mm. of the screen. At the 18 mm. projection and referencing that character to 18 units of the 24 unit EM square, the character would correspond to an EM square size of approximately 68 points.

Where the character size is greater than 68 points with reference to a 24 unit EM square, then those characters which do not exceed 14 vertical units can be typeset in one pass. These may be ascendeer characters without descenders and descender characters without ascenders and lower and uppercase characters. Suitable shifting of the physical baseline in accordance with the text baseline and 68 point imaging surface can be successfully used to avoid segmenting of most characters. Those characters occupying more than 14 points in the 24 unit EM square such as lowercase "j" having an ascender and "A" are segmented at specially designated segmenting cut lines. The position of the cut lines are selected at locations that will be least visible in the typeset output material. Good locations for cutting characters are at natural gaps and at the upper and lowercase borders (see FIG. 1). For example, characters such as lower case "j", "a" and "o" can be segmented at the lower case borders and the middle of the gap separating two parts of the characters. Other characters having descenders will be segmented where that descender crosses the physical baseline or the text baseline. Other characters located on the baseline can be segmented at the middle of the character. Above 68 point or 18 mm., characters are imaged in as many passed as necessary to display the full character shape.

When the characters require segmenting, the segmenting locations can be located in the data store for each character. For example, where the characters are stored in a dot matrix memory, the rows and columns within the matrix can be read either up to a segmenting line or started from a segmenting line depending upon the section of the character to be displayed. Where outline encoding is used, as in the preferred embodiment, the segment locations can be referenced as to the encoding points on the coordinate system.

When the area for accents is inside the screen, then the character is imaged in one pass.

Where the uppercase area is outside the screen, the character is imaged in successive passes.

Where the uppercase area is inside the screen, and the lowercase is outside the screen, the character is imaged in successive passes.

Where the uppercase area is inside the screen and the lowercase area is inside the screen, the uppercase area is imaged in a first pass with the lowercase area.

Where the uppercase area is inside the screen and the area for descenders is outside the screen, the uppercase area is imaged in the first pass.

Where the uppercase area is inside the screen and the lowercase area is inside the screen and the area for descenders is inside the screen, the uppercase area is imaged in a first pass together with the lowercase area and the area for descenders.

Where the superior (uberrangenden) uppercase area is inside the screen, the uppercase area is partially imaged.

Where the lowercase area is outside the screen, the character is imaged in successive passes.

Where the lowercase area is inside the screen, the lowercase area is imaged.

Where the lowercase area is inside the screen and the area for descenders is outside the screen the character is imaged in successive passes.

Where the superior lowercase is inside the screen the lowercase area is partially imaged.

Where the area for descenders is outside the screen, the character is imaged in successive passes.

Where the area for descenders is inside the screen, the area for descenders is imaged.

The invention may be implemented in two steps. A first step requires that characters be analyzed for the best location of the segment lines. This has been described above with regard to accented characters, characters have ascenders and characters having descenders. The second step requires a determination of the physical baseline on the CRT screen relative to the text baseline or in the case of other imagiing devices such as light sources, the location of the physical baseline of the imaging means relative to the borders of the available imaging area. As stated above, and as this invention is described, using the example of a CRT screen, the second step requires a decision for the location of the physical baseline on the screen.

According to the preferred embodiment where more than one line of characters may be imaged on the screen without movement of the screen relative to the imaging surface, then the character baseline need not be shifted nor segmenting be accomplished except for those characters located on baselines near the borders of the screen and where the characters on those text baselines have portions extending outside the available screen area. For those cases, the respective text baselines may be imaged after incrementing or displacement of the screen relative to the image surface, and with another group of text baselines.

To add an explanation, the procedure according to the principals of the invention is explained with reference to a character size permitting only one line of text be imaged on the tube at one time.

It is assumed in the example that the screen has an initial physical baseline location for imaging the characters and that decisions with regard to shifting of the baseline or segmenting are made relative to that initial baseline location and the character size relative to the boundaries of the screen.

As a first step, the designated size of the character when imaged must be compared with the distance of the screen from the baseline to its top vertical boundary in a first direction and bottom vertical boundary in a second direction, for characters having ascenders and descenders, respectively.

Where the character is less than the full size of the screen given as 18 mm. in the preferred embodiment, then the physical baseline is shifted on the screen either upwardly or downwardly in a vertical direction to accommodate the full character. The imaging surface is then moved relative thereto to bring the text baseline in correspondence with the physical baseline.

Additionally, according to the inventive principles, the class of the largest character that could be imaged within the screen can be determined. For example, and is typical in typesetting and printing, in a font of one size, characters can be classified according to individual character size such as lowercase without ascenders, lowercase with ascenders, uppercase without accents, uppercase with accents, lowercase with descenders, and lowercase with extended descenders. These characters are usually designed such that lowercase characters are the smallest and the uppercase characters with accents are the largest. A typical example of such a classification with a single size font would produce the following classes ranging from smallest to largest characters:

(a) (smallest) lowercase characters, (b) next in size) lowercase characters with descenders, lowercase characters with ascenders, (c) (next in size) lowercase characters with extended descenders and uppercase characters, (d) (greatest in size) uppercase characters with accents.

The decisional process would require an examination of each class size from largest size to the smallest and identify the class of characters being the largest size which will fit on the screen at the designated imaging size.

The baseline on the screen would be adjusted as necessary shifting it to accommodate those characters of that identified class. Further, within this decisional process, characters having descenders may be excluded leaving only uppercase with accents, uppercase and lowercase with ascenders and lowercase characters to be considered. For the sake of explanation we will assume the latter case, that only the uppercase with accents, lowercase with ascenders and uppercase and lowercase will be considered in the above.

The screen is typically divided into a number of lines. These lines are used to index the screen in the vertical or "y" direction. The line resolution is typically finer than the resolution between text lines. As stated above for the purpose of this example, it is assumed that one baseline is located on the screen, and that then the screen is indexed into a maximum of 240 lines. As is well-known, the lines in the "y" direction may form a grid in conjunction with lines in the horizontal or "x" direction. By well-known techniques, the imaging beam within the CRT screen may be located at any point on the screen referenced to the "x-y" grid and the characters may be imaged accordingly by controlling the movement of the beam. As is well-known to those skilled in the art, the lines dividing the screen in the "y" direction may be referenced to the text baselines and to the location of the imaging surface opposite the CRT screen. The beam may then be moved to image a character with the film surface moved relative thereto as necessary to move the film surface opposite the beam to image a new text line or segmented portions of characters appearing on the same text line.

Assuming the process starts by selecting the class of largest characters which can be imaged on the available screen at the desired image size, the process continues by separately identifying those characters larger than the screen in a first direction and located off the top of the screen and those characters larger than the screen in a second direction off the bottom of the screen. The process then determines the baseline location on the screen necessary to image the identified class of characters.

The process then may group those characters imaged off the screen relative to the designated screen baseline which are equal to or less than the size of the screen which can be imaged within a previous or the successive increment of the imaging surface relative to the screen. As will be obvious to those skilled in the art, the characters may be referenced to the specific lines in the "y" direction across which the characters are imaged and characters may be sorted for imaging in separate passes depending upon the respective lines for each character. An example is shown with respect to FIGS. 8*a* and 8*b* but it should be understood that the combination chosen for imaging characters may be changed without deviating from the principles of the invention.

The lines may be arranged into groups corresponding to respective passes. The characters arranged within the separate groups may be arranged in a stack relative to the order of lines in the "y" direction and imaged when the imaging surface is moved into a position relative to the screen corresponding with the designated "y" values of a respective group.

The "y" values for lines corresponding to characters which have been imaged would then be removed from the stack, the "y" value addresses of the stack would be incremented upon the next relative movement of the screen and the film corresponding to their relative position and the screen "y" values for imaging of the next group of characters.

The process is described with reference to FIG. 8 again and for the sake of explanation, the CRT screen is assumed to be divided into 300 vertical lines. As can be seen, the upper case "A" without accent, imaged at the specified size, will be juxtaposed on 100 lines corresponding to the full vertical length of the screen. The larger lowercase "j" at its image size will occupy 100 lines exclusive of the dot. The lowercase "o" will occupy approximately 60 lines. The lower case "j" inclusive of the dot will occupy approximately "60" lines. The accent above the "A" will occupy approximately 20 lines. The largest character being the "[" will occupy 160 lines with 20 lines extending above the midportion of the bracket and 30 lines extending below the midportion of the bracket.

A portion of the characters may be imaged in one pass as they occupy no more than the full size of the screen. Other characters will require segmenting and separate imaging. In this case, the "U" and the "A" without the accent can be imaged in one pass. For example, the decision may be to image those complete characters that can be imaged in one pass and fall on lines 100 to 200 and to image those characters that extend beyond 100 imaging lines but can be segmented by a gap. This means the "A", the "U" and the lowercase "o"0 falling within lines 99 to 199 will be imaged in one pass.

The decisional logic may then separate those characters such as the larger lowercase "j" and the smallest lowercase "j" and the accent above the "A" which can be imaged within the screen on 100 lines or less and can be imaged in one pass. Characters which can be imaged in one pass are rare grouped by common "y" values. The screen is moved relative to the imaging surface to locate those designated "y" values within the screen and the imaging sequence is resumed. In this way, whole portions of a character may be imaged without segmenting. The result of the process can be seen in FIGS. 8*a*, 8*b* and 8*c*. Segmented characters (i.e. the accent "O" and "[") are segmented and those segmented portions are imaged in the first pass corresponding to imaging lines of a first set of "y" values. In a second pass, a second group of characters or segments thereof are imaged on a second set of "y" values. Further, those characters which extend over more than 100 image lines but which can be segmented into parts each imaged on less than 100 image lines may be separately imaged as two separate characters such as the "A" with accent and the larger lowercase "j". In each case, where the segmented portions are less than 100 lines, each segment is grouped in common with all other character lines on the same imaging lines having the same "y" values. In such a case, the main body portion of the larger lowercase "j" is imaged with the smaller lowercase "j" while the dot portion of the larger case "j" is imaged with lowercase "o", the capital "A" and "U".

Within the preferred embodiment, the decisional logic for imaging a character is given in the following. As shown in FIG. 1, the accent area is the area from 0 to 4 units from the top of the EM square. The area for uppercase is the area from 4 units from the top to 18 units from the top or 14 units. The area for lowercase is from 8 to 18 units or a total of 10 units. The area for descenders including the extension area for long descenders is from 18 to 24 or a total of 6 units.

In the following, the character size is given relative to the screen.

When the accent area of the character is outside the screen, then the character is imaged in successive passes.

For any font (set of typeface characters) a table may be established indicating the projected size or displayed size relevant when segmenting is initiated, all relative to the encoded size. As stated above, characters are encoded on a coordinate system which in the preferred embodiment is shown as a 24 unit EM square. For the preferred embodiment, and the specific application of typesetting, characters are encoded in an EM square with a defined unit spacing size. Within that EM square size, some of the characters will be larger than others. For example, an "A" will be larger than the lowercase "a" and a "A" having an accent will be larger than the "A" without such an accent. Additionally, some characters of the same size will occupy different portions of the 24 unit EM square used for defining the character and two characters of the same EM square size and aligned on the same baseline may have portions extending beyond the screen. For example, a lowercase "j" having a descender aligned on the baseline with a "A" may both be of a size that causes the "A" to fill the screen completely while the bottom portion of the lowercase "j" extends beyond the bottom of the screen. A decisional logic system can then be based upon the location of the character in the EM square used to define the character (the encoding EM square), as well as the size of the character within the encoding EM square.

TABLE I

| Char | Lower Case - Border | Upper Case Border | Extended Baseline | Char Unit Size (24 Unit EM Square) |
|---|---|---|---|---|
| a | 0 | 0 | 0 | 10 units = 18 mm |
| q | 0 | 0 | 1 | 14 units = 18 mm |
| j | 1 | 0 | 1 | 16 units = 18 mm |
| A | 1 | 0 | 0 | 14 units = 18 mm |
| Ä | 1 | 1 | 0 | 18 units = 18 mm |
| [ | 1 | 1 | 1 | 24 units = 18 mm |

As shown in Table I, each of the characters are analyzed with respect to its position within a 24 unit EM square (used in the preferred embodiment) and the number of units occupied by the character within the 24 unit EM square. The last column within Table I then provides the relationship between the number of units occupied within the encoding EM square by the character and the maximum character size for a defined screen size which serves as a criteria for implementing the segmentation process. For example, lowercase "a" does not extend beyond the lowercase border, the uppercase border or the extended baseline. Lowercase "a" would be defined within the EM square shown on FIG. 1 between unit 8 and unit 18, occupying a space of 10 units. When lowercase "a" is displayed at the maximum screen size or at a height of 18 mm. for the preferred embodiment, such that its 10 units within the EM square is projected onto a display size of 18 mm., then at that point for sizes beyond the EM square size corresponding to the lowercase "a" size of 18 mm., segmentation would be required. As would be understood by those skilled in the art, the EM square outline or the size of the encoding EM square of 24 units as shown on FIG. 1 as projected on the display would be larger than 18 mm., when the lowercase "a" occupying a portion of the encoding EM square and, therefore, a portion of the total EM square is at the maximum display height.

Lowercase "q" having a descender and extending beyond the extended baseline as shown in FIG. 1 would require segmentation when larger than the display size of 18 mm., corresponding to that 14 unit encoded size.

Similarly, for a lowercase "j", which extends beyond the lowercase border in the upper direction and extends beyond the extended baseline in the lower direction and occupies 16 units of the encoding EM square's 24 units, then segmentation will be required when that character is displayed at 18 mm. corresponding to the encoded 16 units.

As can be seen, that as the characters get progressively bigger occupying more of the encoding EM square, for example, 14, 18 and 24 units for the "A", "A" and "[", then segmentation would be required as the number of units corresponding to the character, for example, 14, 18 and 24, respectively, are projected onto the maximum available display or at a size of 18 mm. for the preferred embodiment.

As can be seen, that where a typeface is encoded on a coordinate system of X vertical units and is to be displayed on a display size of Y vertical units such as millimeters, then a lowercase character occupying 10 encoding units with a 24 unit EM square can be displayed at a typeface size or EM square size of 43.2 mm. That 43.2 mm. at 0.351 mm. per point corresponds to a typeface size of 123 point. As can be seen, a typeface defined in an EM square size of 123 point will have lowercase characters such as lowercase "a" capable of being displayed on the 18 mm. screen before segmenting. As the number of units occupied by the encoded characters within the encoding EM square increase, the size of the typeface where segmentation would become necessary given in terms of the EM square size, will decrease with respect to the display size of the character. For example, for a 16 unit character, an 18 mm. display size for the character would correspond to a display EM square size of 27 mm. Thus, 27 mm. would be equivalent to 77 point at 0.351 mm. per point.

Figure 8B:
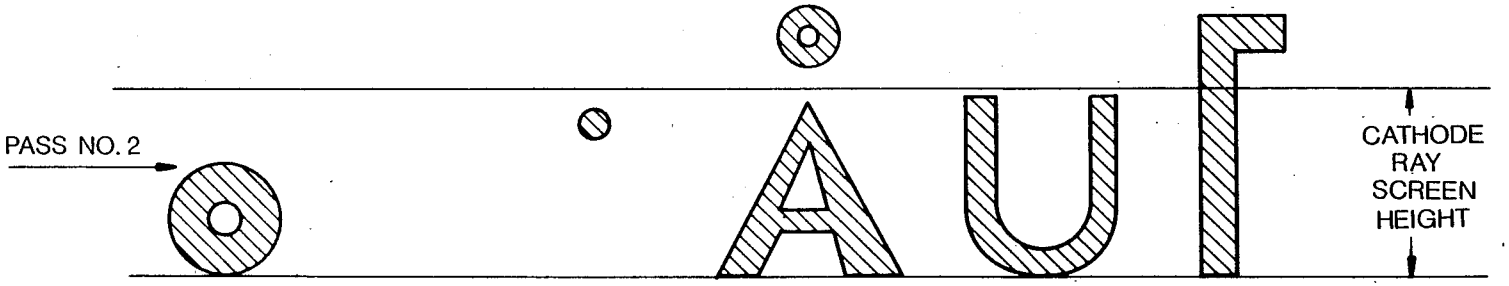
Figure 8C:
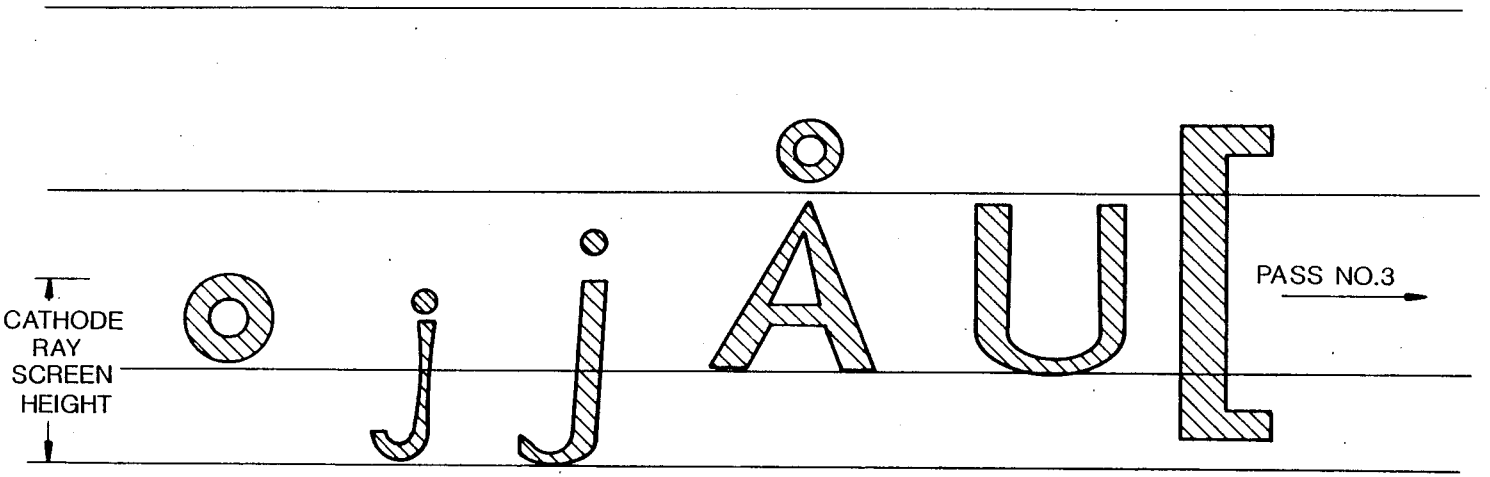

Table I can be used to determine when to segment a character and in which of the successive passes to image the character. For example, characters with descenders having portions extending outside a display screen would be imaged in a successive pass as shown in FIG. 8*a*, 8*b* and 8*c*. While characters with gaps such as the "A" and the lowercase "j" could be imaged either in one pass where the character fits within the screen on that one pass or separately where the character may be segmented such as by gaps.

Table I is described with reference to the preferred embodiment, it being understood that the application of the principles therein to other systems with different screen sizes and different coordinate encoding systems could be accomplished consistent with the principles of the invention. One such calculation, for example, would be to determine whether any portion of the character given the baseline location on the screen extends beyond the screen. If that character is still within the maximum screen size, it would be imaged on the subsequent or preceding scan. If segmentation was required then, it would be segmented given the stored locations within the data where the character may be segmented and imaged in separate passes. As stated earlier, characters having gaps may be segmented at the gap. Characters may otherwise be segmented in the middle which may be indicated by a default condition or it may be segmented at any other suitable portion, for example, as shown by the "[".

What has been shown here is a method for imaging characters on a screen by shifting the baseline location of the character to accommodate the full size of the character or where the character is enlarged on the display, of identifying locations in the character or characters will be divided into separate sections and then displayed in separate sections separately on a screen. Attached is the listing for implementing the aforesaid invention, the listing given in a high level PASCAL language.

Procedure for the exposure of large type sizes with line spacing:

In the procedure 'editing', the line spacing status is set when characters within the text line surmount the confines of the tube window (given by the exposure-active diameter of the tube). During the procedure 'line synthesis', this line is removed from the text line chain and is added to a line spacing chain.

In doing so, the preparation of this line for the 1. exposure pass is obtained.

The line spacing chain is processed in the background with the procedure 'YADVANCE_ LINESPACING' analogous to the line stack.

The exposure window is shifted thereby from pass to pass from top to bottom over the interface line to be exposed. The interface positions for the characters are preset to the values

| | |
|---|---|
| upper position = | 14/18 type size |
| center position = | 10/19 type size |
| base line = | −20/432 type size |
| descender = | −6/18 type size |

In case a font contains informations of interface positions, then these values are substituted by the indicated position values.

Informations of the interface positions cause the placing of the interface position outside of the character flesh into the white area of the character.

In case of very large type sizes at which the ascenders and the center letters, respectively, surmount the tube window, additional interface positions are provided which then, however, are positioned within the flesh of the character.

Decision table for the exposure of partial lengths of interface characters

| | | | | | | | | | | | | | | | | | | |
|---|---|---|---|---|---|---|---|---|---|---|---|---|---|---|---|---|---|---|
| Conditional part | | | | | | | | | | | | | | | | | | |
| accent position | outside of exposed window | x | | | | | | | | | | | | | | | | |
| accent position | within exposed window | | x | | | | | | | | | | | | | | | |
| ascender | outside of exposed window | — | — | x | | | | | | | | | | | | | | |
| ascender | within exposed window | | — | | x | x | x | x | | | | | | | | | | |
| surmounting ascender | within exposed window | | | | | | | | x | | | | | | | | | |
| center letter | outside of exposed window | — | — | — | | | | | — | x | | | | | | | | |
| center letter | within exposed window | | — | | | x | x | x | | | x | x | x | | | | | |
| surmounting center letter | within exposed window | | | | | | | | | | | | | x | | | | |
| descender | outside of exposed window | — | — | — | — | | x | | — | — | | x | | — | x | | | |
| descender | within exposed window | | — | | | | | x | | | | | x | | | | x | |
| Action part | | | | | | | | | | | | | | | | | | |
| exposure | accent length in act. pass | | x | | | | | | | | | | | | | | | |
| exposure | ascender in act. pass | | | | | x | x | x | | | | | | | | | | |
| partial exposure | ascender in act. pass | | | | | | | | x | | | | | | | | | |
| exposure | center letter in act. pass | | | | | x | | x | | | x | | x | | | | | |
| partial exposure | center letter in act. pass | | | | | | | | | | | | | x | | | | |
| exposure | descender in act. pass | | | | | | | x | | | | | x | | | | | x |
| exposure in a subsequent pass | | x | | x | x | | | | | x | | x | | | x | | | |

Explanation of terms
x = condition existing/execute action
— = condition not relevant
blank = condition not existing/no action
within exposed window = referred-to length is completely within act. window
outside of exposed window = referred-to length does not lie or only partly lies in the exposure window
surmounting = ascender/center letter surmounts diameter of window
partial exposure = partial exposure of ascender/center letter through provision of an additional interface position within the flesh of the character An exposed partial length of a character is regarded as nonexisting for subsequent passes.

Interface characters are exclusively exposed upon advancing carriage movement while characters which are not subjected to the interface condition are exposed like normal characters upon advancing or returning carriage movement.

The line spacing chain is processed in the background with procedure YADVANCE-LINESPACING analogous to the line stack.

The value of the film advance is divided up and an exposure pass for a line spacing line is respectively forwarded after output of a part piece.

After output of each film advance, the YPASS values of the line spacing chain are reduced by the value of the film advance.

After each exposure pass, by procedure LINESPACING, the subsequent pass is prepared or the line is erased from the line spacing chain.

```
Tree 5
======

Prepare line spacing of line spacing pass for 1 line
--+--
   ZVALUEREDUCTION of the interface position values about
   the exposed positions
  +--+--
     Interface bound for advanced pass
     +-----
  prepare LINESPACINGTERMINATION and if necessary passØ or pass6
  determine MINMAXVALUE of positions from the interface table
  +----
RINTERFACE = RECORD
 APOSITION, OPOSITION, MPOSITION, UPOSITION, BPOSITION,
 ULOW, WORD,
 AL, OL, UL,ZQUIT, ULINE, BOOLEAN
```

```
Interface positions in 10µm units:
APOSITION = accent position
OPOSITION = height of ascending letter
MPOSITION = height of center length
UPOSITION = depth of descending letter
BPOSITION = depth of base line
ULOW      = depth of underlining
AL        = APOSITION existing
OL        = OPOSITION existing
UL        = UPOSITION existing
ULINE     = underlining existing
ZQUIT     = exposure terminated

ALENGTH = (A5, A15, A3Ø)
PINTERFACE = @AINTERFACE
AINTERFACE = RECORD
   CASE  TAGINTERFACE  : ALENGTH of
     A5 : (ARR5        : ARRAY[1..5] of RINTERFACE);
     A15: (ARR15       : ARRAY[1..15] of RINTERFACE);
     A3Ø: (ARR3Ø       : ARRAY[1..3Ø] of RINTERFACE);
END;
(******************** LINE SPACING CHAIN ******************)

(* All text lines having line spacing status and such having
   pass identification = 1/3 of rev.led are added to the
   line spacing chain. *)

PLINESPACING = @RLINESPACING

RLINESPACING = RECORD
        NEXT : PLINESPACING;
        TEXTPOINTER : PTEX;          (*pointer for the text line *)
        YPASS : INTEGER;             (*value of film advance for
                                       the waiting pass *)
        YBASELINE : INTEGER;         (*position of the base line
                                       relative to the actual
                                       film position *)
        JOBACTIVE : BOOLEAN;         (*TRUE, when subsequent pass
                                       is required *)
        FILMADVANCEUNCONDITIONAL : BOOLEAN;
                                     (*film advance must be prior
                                       to change of cartridge *)
END;
Procedure Interface Bound
(Var LOWERINTERFACEBOUND:WORD; Var NIB, FINISHED: BOOLEAN;
 Var INTERFACETABLE:RINTERFACE; SHIFT:WORD);

(*Calling of procedures line spacing and line decision.
Determination of the lower interface bound upon line spacing.
Providing an additional interface position above the BPOSITION
when OPOSITION or MPOSITION do not completely fit into the
exposure window.
```

relative to the base line

The interface of the characters is in this case, however, within the flesh of the character.

```
Input parameter: INTERFACETABLE-VALUES
                 SHIFT = SHIFT in text line  H
Output parameter:NIB   = TRUE if boundary below the tube window
                         ELSE FALSE
            FINISHED  = TRUE if no subsequent pass necessary,
                         ELSE FALSE
        LOWERINTERFACEBOUND = lower interface bound relative
                              to log. base line *)
```

page 30

```
Var PASSUPPERBOUND, PASSLOWERBOUND: WORD;
BEGIN
   NIB := FALSE;
   FINISHED:= FALSE;
   PASSUPPERBOUND := -SHIFT+TSMAX;
   PASSLOWERBOUND := -SHIFT+BJMAX
   WITH INTERFACETABLE DO BEGIN
      IF AL THEN BEGIN
      (*pass1 for accent position *)
      IF OPOSITION>= PASSLOWERBOUND  THEN LOWERINTERFACE
      BOUND := OPOSITION
      ELSE NIB:TRUE (* expose APOSITION later *) END
ELSE (* no accent position existing *) BEGIN
IF OL THEN BEGIN
   IF MPOSITION>= PASSLOWERBOUND THEN BEGIN
      IF BPOSITION>= PASSLOWERBOUND  THEN BEGIN
         IF UL THEN BEGIN
            IF UPOSITION >= PASSLOWERBOUND THEN BEGIN
               LOWERINTERFACEBOUND := UPOSITION
               FINISHED := TRUE END
            ELSE LOWERINTERFACEBOUND := MPOSITION  END
         ELSE BEGIN
            LOWERINTERFACEBOUND := BPOSITION
            FINISHED := TRUE  END  END
         ELSE IF OPOSITION >= PASSUPPERBOUND THEN LOWERINTERFACE
                              BOUND  := MPOSITION
            ELSE NIB := TRUE;  END
    ELSE (*set MPOSITION higher when OPOSITION is too big for
    exposure window or expose later *)  BEGIN
       IF OPOSITION >= PASSUPPERBOUND THEN BEGIN
          MPOSITION:=PASSLOWERBOUND;
          LOWERINTERFACEBOUND:=MPOSITION END
       ELSE NIB := TRUE (*expose OPOSITION later *)  END;
END
```

```
ELSE (* no OPOSITION existing *) BEGIN
   IF BPOSITION >= PASSLOWERBOUND  THEN BEGIN
      IF UL THEN BEGIN
         IF (UPOSITION >= PASSLOWERBOUND) OR ( BPOSITION >=
         PASSUPPERBOUND) THEN BEGIN
            LOWERINTERFACEBOUND:= UPOSITION;
            FINISHED :=TRUE  END
         ELSE IF MPOSITION >= PASSUPPERBOUND THEN
         LOWERINTERFACEBOUND := BPOSITION
              ELSE NIB := TRUE;  END

      ELSE (*no UPOSITION existing *) BEGIN
      LOWER INTERFACE BOUND := BPOSITION
      FINISHED := TRUE  END;
  END;

  ELSE (* provide additional interface position (TS> 27mm) or
expose later *) BEGIN
   IF MPOSITION >= PASSUPPERBOUND THEN BEGIN
      (* MPOSITION does not fit into the exposure window !
       provide additional interface position and characterize
       as OPOSITION.
       >>>OPOSITION : MPOSITION OLD; MPOSITION NEW :=
       PASSLOWERBOUND;
       LOWERINTERFACEBOUND := MPOSITION NEW *)
       OPOSITION := MPOSITION
       OL := TRUE
       MPOSITION := PASSLOWERBOUND
       LOWERINTERFACEBOUND := MPOSITION  END
   ELSE NIB := TRUE (* expose OPOSITION later *) END
  END
 END
END
```

Procedure editing (P:PTEX; YSHIFT:INTEGER);
==========

```
(*editing of a text line P:
Each marker is subjected to an interface evaluation. The
referred-to fonts are provided with 'font-handler' for
reference to font position informations and accent identi-
fications.
Font position values are checked for reasonableness and
if necessary are substituted by default values wherein
the line status is set to 'INFORMATIONERROR'.
Characters and groups of character which have the same
interface position values are provided with an index value
in the H-byte of the character number.
This index value permits the access to the interface table
PINTERFACE in which the interface position values APOSITION,
OPOSITION, MPOSITION, UPOSITION, BPOSITION, ULOW are
```

recorded in μ-units relative to the log. baseline as well as the existing positions AL, OL, UL, ULINE.
These position values are determined from the font position informations of the fonts or from the ratio values of the quad (at font position values distinction in c1/c2 fonts) and from the type size, CE-value and BASEJUMP.
Underlinings beyond the exposure window lead also to line spacing.
Upon font commands under PRIVIDENTIFICATION, font handler is called with parameter PRIVSYMBOL=TRUE.
In case all called font commands are present as PRIV-FONTS, the status := FONTRESIDENT is set.
Upon recognition of markers, status CHARACTERIDENTIFICATION is recorded.
Lines are recorded in theline stack (procedure INSETERTLINE), the Y-values being related to YSHIFT (actual film position) while other commands which are irrelevant for the determination of the boundary value of the markers are ignored.
The edited line receives the status 'READY' *)

```
Var
PFONTTABLE :PFONT;
L,A,O,M,U,B : WORD;
ALG, OLG, ULG : BOOLEAN;
TS, CE, BJ, BT, FONTNR, IENTRY, I_ACCENT, CEXTS : WORD;
LAYOUT : LAYOUTIDENTIFICATION;
INTERFACEIDENTIFICATION, NB, PAR_VALUE, ACCENT, FO_VALUE,
PRIVSYMBOL, UNDERLINE  : BOOLEAN;
FPSTATUS : FPSTAT;
ULINELOW : WORD;

FUNCTION FLAYOUT : LAYOUTIDENTIFICATION;
(* formation of the font layout identifications C, X, D, S *)

Var
LOUT : INTEGER;

BEGIN
  IF FONTNR<Ø THEN LOUT:=FONTNR + 65536  (*bit 15 = 1 *)
  ELSE LOUT:=FONTNR;
  LOUT:= LOUT DIV 16384;  (* bits 14 and 15 *)
  CASE LOUT OF
    Ø : FLAYOUT:=C;
    1 : FLAYOUT:=X;
    2 : FLAYOUT:=D;
    3 : FLAYOUT:=S;
  END;
END;

FUNCTION FCEXTS  : WORD;
   BEGIN FCEXTS:=CE * TS  DIV 64  END;
```

```
Procedure Marker (VERSAKCCENT ; BOOLEAN; I1 : WORD);

(*Interface evaluation and entry of the interface position
values and identifications for existing positions in the
character in the interface table
when the boundary values
of the characterrelative to the base line outside of the
window;
When angstrom characters, the ascender : of an interface
character is reduced by the factor Ø.95 (corresponds to
Ø.98 * maximum ascender)
When interface identification an additional table entry is
thereby generated;
Indexing of characters upon reference to interface table;
Evaluation parameter: CEXTS (TS means type size), BJ,
fontlayout, vers-angstrom, font position information,
identification 'expanded  ascender';. underlining lower edge;
maximizing of upper boundary, lower boundary when no interface
condition,
call procedure "font_handler" when parameter value and font
value TRUE.

Value assignemnt : TEX [I1], P interface, upper boundary,
                   lower boundary, status=character identification

input variable   : CEXTS (TS means type size), BJ, font number,
                   font value, A, O, M, U, interface
                   identification *)

VAR
CH : WORD
special character, angstrom : boolean;
Function interface evaluation : boolean;

(*Evaluation of the character with respect to interface condition;
Determination of the interface positions A, O, M, U from
                CEXTS, BJ, font position information
and C2 font-status;
Upon font position informations, the value A is obtained
by extrapolation about the factor 1.39 from the ascender
value of the font. Through this measure, it should be caused
that characters, like e.g. O/ do not appear in such a way
that their upper part is cut off.

In case of  D-layout or no font position informations,
then enter default values for interface position values.

Reasonableness check of the font position values; if necessary
substituting by default values and setting line status =
information error.
```

```
Interface condition TRUE IF O >TSMAX, U <BJMAX or underlining
with lower edge <BJMAX;
When FO_Value then font_handler call,
Status := -FONTRESIDENT IF NOT PRIV_FONT.

Value assignments : A, O, M, U, B, PFONTAB, FO_Value

Input variables : FO_Value, FONTNR, CEXTS
                  BJ    *)

Var C2fact : word;

BEGIN
  IF FO_VALUE THEN
  BEGIN (* get font table for font number *)
   FO_VALUE := FALSE
   FONT_HANDLER (FONTNR, FALSE, PFONTTABLE, FPSTATUS);
   IF NOT (PRIVFONT IN FPSTATUS) THEN P0.STATUS:=P0.STATUS-
   [FONTRESIDENT];
END;
WITH PFONTTABLE , P  DO
BEGIN
  IF BT <>0  THEN BJ:=FONTTABLEBT(CEXTS, BT, PFONTTABLE);

     A:=CEXTS + BJ;
     O:=(CEXTS * 14 DIV 18) + BJ;
     M:=(CEXTS * 10 DIV 18) + BJ;
     U:=-(CEXTS * 6 DIV 18)+ BJ;
     B:=-(CEXTS * 20 DIV 432 ) + BJ;
  IF (OUINFORMATION IN FPSTATUS) AND (LAYOUT()D) THEN
  BEGIN (* font position information existing *)
     IF C2 IN FPSTATUS THEN C2FACT:=2  ELSE C2FACT:=1;
     L:=(CEXTS * BAJUM[MAXASCENDER] DIV 310 DIV C2FACT) + BJ;
     (*extrapolated *)
     IF L < A THEN A := L;
     L:=(CEXTS * BAJUM[MAXASCENDER]  DIV 419 DIV C2FACT)+BJ;
     IF L> A THEN STATUS := STATUS + [INFORMATIONERROR]
     ELSE O := L;
     L:= (CEXTS * BAJUM[MAXCENTER] DIV 432 DIV C2FACT)+BJ;
     IF L >O THEN STATUS := STATUS +[INFORMATIONERROR]
     ELSE M := L;
     L:=(CEXTS * BAJUM[MAXDESCENDER] DIV 432 DIV C2FACT)+ BJ;
     IF L <U THEN STATUS := STATUS + [INFORMATIONERROR]
     ELSE U := L;
  END;

  IF (O>TSMAX) OR (U< BJMAX) THEN
     INTERFACEEVALUATION:= TRUE
  ELSE
  INTERFACEEVALUATION:= FALSE
```

```
IF UNDERLINE AND (ULINELOW < BJMAX) THEN INTERFACEEVALUATION:=
TRUE;

END;
END:



Procedure interface entry;

(* Generating and scaling of fields for the interface tables;
Look for known character group (O M U OL UL are equal) in
interface table,
when interface values unknown, then reentry of A, O, M, U,
B, AL, OL, UL and entry of the status line spacing identification;
Entry ULINE, ULOW upon underlining;
Expand FOLOCNR by index value for access to interface table
      (FOLOCNR := FOLOCNR + INDEX *256)

Input parameter: A, O, M, U, B, = Z-values in 1Ø µ units
OLG, ULG, UNDERLINE, VERSACCENT

Output parameter: interface table entries;
APOSITION, OPOSITION, MPOSITION, UPOSITION, BPOSITION,
ULOW = interface positions in R-interface
AL, OL, UL, ULINE;
Index for FONTLOC-NR in text buffer;
Status line spacing     *)

Var
TEMP : PINTERFACE;
 FOUND : BOOLEAN;
 IINTERFACE,INDEX : WORD;
 ACCENTBITS : BYTE;
BEGIN
   TEMP :=NIL;

   WITH P@ DO BEGIN
      STATUS := STATUS + [LINE SPACING]

      (* prepare scaled field for interface tables *)
      IF  PINTERFACE =NIL THEN BEGIN
      NEW (.PINTERFACE, A5);
      SCALED INTERFACE TABLE (.PINTERFACE, (5*9 + 1));
       PINTERFACE@ .TAGINTERFACE := A5;
       IENTRY :=1
      END

(* defining of the position identification.  *)
IF (OUINFORMATION IN FPSTATUS).          AND (LAYOUT()D) THEN
```

```
BEGIN
(* Fontposition informations existing *)
   ACCENTBITS := FONTTABLE  ACCENTSHIFT [CH];
   IF PICTURE (ACCENTBITS, 4) OR  VERSACCENT THEN
   ALG . . : := TRUE ELSE ALG . ..  :=FALSE
   IF PICTURE(ACCENTBITS, 1) THEN
   ULG  . . := TRUE ELSE ULG .  := FALSE
   IF PICTURE(ACCENTBITS, 2) THEN
   OLG  .. .. := TRUE ELSE OLG    .. := FALSE:
END
ELSE BEGIN (* no fontposition informations existing *)
   IF SPECIAL CHARACTER THEN
   ALG . .... := TRUE ELSE ALG      . ;=FALSE;
   OLG .  := TRUE;
   ULG ..  .. := TRUE;
END
(* Look for same interface table in array *)
FOUND := FALSE
FOR INDEX:=1 TO IENTRY DO BEGIN
   IINTERFACE:= INDEX;
   WITH PINTERFACE@ ARR3Ø [IINTERFACE] DO BEGIN
     IF OPOSITION = O THEN
     IF MPOSITION = M THEN
     IF UPOSITION = U THEN
     IF OL = OLG THEN
     IF UL = ULG THEN BEGIN FOUND:=TRUE; EXIT END;
   END;
END;

IF NOT FOUND THEN BEGIN
(* attach new interface table *)
    IF NINTERFACE = 5 THEN BEGIN
       NEW (TEMP, A15);
       SCALED INTERFACE TABLE (TEMP, (15*9 +1));
       TEMP@  TAGINTERFACE := A15; END
    ELSE
    IF NINTERFACE = 15 THEN BEGIN
       NEW (TEMP, A 3Ø)
       SCALED INTERFACE TABLE (TEMP, (3Ø*9 +1));
       TEMP@. TAGINTERFACE : A3Ø; END
    ELSE
    IF NINTERFACE = 3Ø THEN ERROR MESSAGE (PROCESS ERROR);
    (* ERROR !!!!!*)

    IF TEMP <> NIL THEN BEGIN
       (* array transmission old --) new-array *)
       FOR INDEX:=1 TO NINTERFACE DO
       TEMP@.ARR3Ø [INDEX] := PINTERFACE@.ARR 3Ø [INDEX];
       DISPOSINTERFACE (PINTERFACE);
       PINTERFACE := TEMP;
```

```
    END
END;
WITH PINTERFACE↑.ARR30 [IINTERFACE] DO BEGIN

   IF NOT FOUND THEN BEGIN
   (*entriesA,O,M,U,B, status *)
      APOSITION:=A;
      OPOSITION:=O;
      MPOSITION:=M;
      UPOSITION:=U;
      BPOSITION:=B;
      OL  :=OLG;
      UL  :=ULG;

      IENTRY := SUCC (IENTRY);
      MINTERFACE := SUCC (MINTERFACE);
   END;

   (*auxilliary entries *)
   AL := AL OR ALG;
         IF UNDERLINE THEN BEGIN
            ULINE := TRUE
            ULOW  := ULINELOW END;
     END;

     (* indexing of the character in the text buffer *)
     TEX [I] := CH + IINTERFACE*256;

  END;
END;
      END;

      STATUS:=STATUS+ READY ;
   END;
 END;

(*  F=LINESPACING*)
Procedure line spacing (PLINESPACING : PLINESPAC);

(* preparation of the line for the line spacing pass.
Resetting of 'QUIT' in the status;
Compensation of deviation of the log. to the physical base
line from advanced pass;
line value reduction of the upper boundaries in the interface
value tables by the positions already exposed from 2. to
N. pass;
Determination of SHIFT value for the deviation of the log.
to the physical base line and reduction of YPASS by exactly
this deviation;
Adjusting of 'PASSIDENTIFICATION' in the line spacing line;
```

Recognition of change of positive to negative deviation of the exposure window and inserting of PASSØ for the exposure od all characters without interface identification in group. In case of underlining upon line spacing then for this underlining a pass (6) is attached.

Output parameter: JOBACTIVE = FALSE if line spacing quit
YPASS = actual line feed value for this pass
SHIFT = deviation of the log. to the physical base line in the line spacing line
INTERFACE TABLE = upper boundaries of the position values for the actual pass
STATUS = 'QUIT' resetting in all group lines
PASS IDENTIFICATION = 4 for positive deviation of the exposure window
Ø for exposure of the characters without interface identification
5 for negative deviation of the exposure window
6 for underlining *)

```
Var
LINESPACINGQUIT, UNDERLINE   : BOOLEAN;
ZMINVALUE, ZMAXVALUE : WORD;

Procedure ZVALUEREDUCTION;
(* The upper boundaries of the Z-values in the interface
tables of the actual line are reduced by the positions exposed
in the advanced pass.
The following values are altered: AL, OL, MPOSITION, BPOSITION,
ZQUIT;
When all table components have ZQUIT=TRUE,
then LINESPACINGQUIT:=TRUE  ELSE LINESPACINGQUIT:=FALSE  *)

Var
INTERFACETABLE : RINTERFACE;
INDEX  : WORD;
LOWERINTERFACEBOUND  : WORD;
NIB  :  BOOLEAN;

BEGIN
  LINESPACINGQUIT:=TRUE;  (*presetting *)
  WITH PLINESPACING@.TEXPOINTER@. DO BEGIN
     FOR INDEX:=1 TO NINTERFACE   DO BEGIN
       INTERFACETABLE:=PINTERFACE@.ARR3Ø [INDEX];
       WITH INTERFACETABLE DO BEGIN
           IF NOT ZQUIT THEN BEGIN
           INTERFACEBOUND (LOWERINTERFACEBOUND, NIB, INTERFACETABLE,
                           SHIFT);
           IF NIB THEN LINESPACINGQUIT:=FALSE
```

```
          ELSE BEGIN
          (*This group was exposed; ZVALUEREDUCTION to the
          value determined by LOWERINTERFACEBOUND *)
            IF LOWERINTERFACEBOUND=OPOSITION THEN AL:=FALSE
            ELSE IF LOWERINTERFACEBOUND=MPOSITION THE OL:=FALSE
            ELSE IF LOWERINTERFACEBOUND=BPOSITION THEN BEGIN
               OL:=FALSE;
               MPOSITION:=BPOSITION; END
            ELSE IF LOWERINTERFACEBOUND=UPOSITION THEN BEGIN
               OL:=FALSE;
               MPOSITION:=UPOSITION;
               BPOSITION:=UPOSITION;  END;
               (*rewriting of the interface table into the array*)
               PINTERFACE@.ARR30[INDEX] :=INTERFACETABLE
               IF NOT ZQUIT THEN LINESPACINGQUIT:=FALSE; END;
            END;
         END;
      END;
   END;
END;

Procedure MINMAXVALUE;
(*MIN/MAXVALUES of the interface positions are determined from
the components of the interface table PINTERFACE
(Upon underlining, ZVALUE is, if necessary, determined by
the bottom edge of the underlining). UNDERLINE is TRUE IF ULINE
in the interface tables ELSE UNDERLINE:=FALSE.
IF NOT ZQUIT(component) THEN ZMAXVALUE >= APOSITION/OPOSITION/
                                          MPOSITION
                             ZMINVALUE <= ULOW,UPOSITION,BPOSITION *)

Var
INDEX  : WORD;
INTERFACETABLE : RINTERFACE;

BEGIN
(* presettings *)
   ZMINVALUE:=MAXWORD;
   ZMAXVALUE:=MINWORD;
   UNDERLINE:=FALSE;

WITH PLINESPACING@.TEXPOINTER  DO BEGIN
    FOR INDEX:=1 TO NINTERFACE DO BEGIN
     INTERFACETABLE:=PINTERFACE@.ARR30[INDEX];
     WITH INTERFACETABLE DO BEGIN
        IF NOT ZQUIT THEN BEGIN

        (* determine ZMAXVALUE  *)
        IF AL THEN BEGIN
           IF APOSITION > ZMAXVALUE  THEN  ZMAXVALUE:= APOSITION
       END
```

```
    ELSE (*no APOSITION existing *)  BEGIN
       IF OL THEN BEGIN
          IF OPOSITION>ZMAXVALUE THEN ZMAXVALUE:=OPOSITION   END
          ELSE (* no OPOSITION existing *)
          IF MPOSITION>ZMAXVALUE THEN ZMAXVALUE:=MPOSITION;
    END;

    (* determine ZMINVALUE *)
    IF UL THEN BEGIN
       IF UPOSITION<ZMINVALUE THEN ZMINVALUE:=UPOSITION  END
       ELSE (* no UPOSITION existing *)
       IF BPOSITION<ZMINVALUE THEN ZMINVALUE:=BPOSITION;
    END;
    IF ULINE THEN BEGIN
       UNDERLINE := TRUE;
       IF (ULOW<ZMINVALUE>THEN ZMINVALUE:=ULOW;  END;
   END;
  END;
 END;
END;


Procedure PASSIDENTIFICATION (identification  :  byte);
(* entry of pass identification for the line *)

   BEGIN
     PLINESPACING@.TEXPOINTER@.PASSIDENTIFICATION :=IDENTIFICATION;
   END;

Procedure LINESPACINGTERMINATION;
(* Termination procedure after status = PASSQUIT;
PASSØ is still executed when pass is headed before with pass
identification = 4;
If pass (6) is not yet executed and if ULIN = TRUE in the
interface tables then pass (6) is attached for underlining  *)

    BEGIN
      WITH PLINESPACINGØ, TEXPOINTER@DO BEGIN
         IF PASSIDENTIFICATION=4 THEN BEGIN
         (* exposure of the group characters without interface
         identification with passØ  *)
            PASSIDENTIFICATION (Ø);
            SHIFT := Ø END
         ELSE (* must pass (6) still be attached for under-
              lining ? *)
         IF (PASSIDENTIFICATION <> 6) THEN BEGIN
            MINMAXVALUE;
            IF UNDERLINE THEN BEGIN
               (* pass (6) for underlining *)
               PASSIDENTIFICATION (6);
```

```
            IF    (ZMINVALUE < BJMAX) THEN
            SHIFT :=   -(ZMINVALUE - BJMAX )
         ELSE SHIFT := Ø;
         YPASS := YPASS = SHIFT
      - FILMADVANCEUNCONDITIONAL := TRUE; END

      ELSE (*line(s) processed in all passes *)
      JOBACTIVE := FALSE
   END
   ELSE (* line(s) processed in all passes *)
   JOBACTIVE := FALSE;

   END;
END;

(******************MAIN LINE SPACING *************************)

BEGIN
  WITH PLINESPACING@, TEXPOINTER@ DO BEGIN
    STATUS := STATUS - [QUIT]; (* reset of QUIT-status *)

    (* Compensation of deviation of the physical base line
    from advanced pass *)
YPASS := YPASS-SHIFT
YBASELINE := YPASS;
FILMADVANCEUNCONDITIONAL := FALSE

IF PASSQUIT IN STATUS THEN LINESPACINGTERMINATION

ELSE BEGIN
   IF (LINESPACINGACTIVE IN STATUS) AND (PASSIDENTIFICATION
   <>Ø) THEN BEGIN    ZVALUEREDUCTION;
      IF LINESPACINGQUIT THEN STATUS:=STATUS +
      [PASSQUIT] END;
   IF PASSQUIT IN STATUS THEN LINESPACINGTERMINATION
   ELSE (* prepare further pass *) BEGIN
      IF LINESPACINGACTIVE IN STATUS THEN
      FILMADVANCEUNCONDITIONAL:=TRUE (*film advance prior to
                                       change of cartridge!*)
      ELSE BEGIN
         STATUS := STATUS + [LINESPACINGACTIVE];
         PASSIDENTIFICATION (4)  END;

      (* determination of SHIFT-value *)
      MINMAXVALUE; (*min/max-value of the positionvalues
                     from the interface table*)
      IF ZMAXVALUE > TSMAX THEN
      (* pass with positive shift of the exposure window *)
         SHIFT := -( ZMAXVALUE-TSMAX)
      ELSE (* pass with negative deviation of the
              exposure window *) BEGIN
```

```
    IF PASSIDENTIFICATION = 4 THEN BEGIN
    (* inserting of passØ for exposure of group
    characters without the interface identification *]
         PASSIDENTIFICATION (Ø)
         SHIFT := Ø; END
    ELSE (*pass-identification <> 4 *)  BEGIN
WITH INTERFACETABLE DO BEGIN

  IF . ZQUIT OR (PASSIDENTIFICATION = 6) THEN BEGIN
     IF (PASSIDENTIFICATION = 6) AND (UNDERLINING IN STATUS)
     THEN BEGIN
         (*execute underlining in pass (6) *)
         OINTERFACE := LYHI;
         UINTERFACE := LYLOW;
         SPACING := TRUE;
         UNDERLINING := TRUE;
         NIEXPOSURE := NB   END
     ELSE BEGIN
        NIEXPOSURE :=TRUE;
        UNDERLINING := FALSE; END;
  END

  ELSE (*Character group not yet QUIT *) BEGIN
     (*determination of UINTERFACE or entry NIEXPOSURE ;=TRUE *)
     interface boundary (LOWERINTERFACEBOUND,NIEXPOSURE,
                         FINISHED, INTERFACETABLE, SHIFT);

     IF NIEXPOSURE THEN PASS2:= TRUE

     ELSE (* interface is executed *)  BEGIN
        LOWERINTERFACE := LOWERINTERFACEBOUND

        (* determination of O-interface *)
        IF AL THEN OINTERFACE:=APOSITION
        ELSE IF OL THEN OINTERFACE:=OPOSITION+OVERLAP
        ELSE OINTERFACE:=MPOSITION+OVERLAP;

        NIEXPOSURE:=NB;
        SPACING :=TRUE  END

     END;
   END;
  END;
 END;
END:
Procedure YADVANCE_LINESPACING (Var YVALUE : INTEGER;
                                PSPACINGBASE : PLINESPACING);

(*Output of Y-value with interpolated jobs for the output
of waiting line spacing passes when line spacing job;
Find line spacing element with minimum Y-pass value (procedure
```

```
FIND_YMIN);
IF YVALUE >= YPASS THEN
Y-job with this determined YPASS-value.
Reduction of Y-value about the executed filmadvance,
reduction of Y-pass in all line spacing elements about the
executed value of the film feed by procedure LINESPACINGADJUST
          ( Y-pass in the actual line spacing element is not
touched because already reducedby procedure YJOB  ),
relocating of the determined line spacing line by procedure
JOBRELOCATING  (1 pass),
preparing of this line for the subsequent pass by procedure
LINESPACING,.
repetition of these procedures with determination of the
min. Y-pass value.
Procedure FIND_YMIN erases processed textlines and sets
LINESPACINGJOB=FALSE when all line spacing lines are output.

After termination of the WHILE-loop or when LINESPACINGJOB=
FALSE, the residual value of Y-value is output.

Input parameter: YVALUE=film advance to be executed in 10 µ-units
                 PSPACINGBASE = pointer to line spacing chain
                 LINESPACINGJOB = switch for execution line
                                  spacing
Outputparameter: YVALUE = non-executable film advance, residual
                          value  *)

Var
PLINESPACING : PLINESPACING
YFILM : INTEGER;
Procedure FIND_YMIN (Var PLINESPACING : PLINESPACING);
(* find the line spacing element with minimum Y-pass value from
the line spacing chain
disposing of line spacing texts with identification JOBACTIVE=
FALSE
(the element of the line spacing chain is, however, preserved
with TEX=NIL);
IF line spacing chain empty, then LINESPACINGJOB:=FALSE
Output parameter : PLINESPACING = pointer on the searched
                                  line spacing element
                   LINESPACINGJOB = FALSE if line spacing
                                    chain empty   *)

    Var
    PTEMP : PLINESPACING;
    YPASS_: INTEGER;

    BEGIN
       IF LINESPACINGJOB THEN BEGIN
```

```
        PLINESPACING := PSPACINGBASE;
        PTEMP := PSPACINGBASE;
        YPASS_ :=MAXINT;
        LINESPACINGJOB := FALSE;
        WHILE PTEMP <> NIL DO BEGIN
           WITH PTEMP@   DO BEGIN
        IF JOBACTIVE THEN BEGIN
           LINESPACINGJOB := TRUE; (*reset on TRUE *)
           IF YPASS < YPASS_ THEN BEGIN
              YPASS_ := YPASS;
              PLINESPACING := PTEMP  END;
        END
        ELSE  (*JOBACTIVE = FALSE *)
        IF TEXPOINTER <> NIL THEN BEGIN
           DISPOSTEX (TEXPOINTER);
           TEXPOINTER := NIL;
           ERRORMESSAGE (RLZEED); (* log end of line *)
        END;
        PTEMP :=NEXT
     END;
   END;
END;
    Procedure LINESPACINGADJUST (YFILM : INTEGER; ACCENTLINE :
                                 BOOLEAN);
(* reduction of the YPASS-values in the linespacing chain
about the film advance;
   the YPASS-value of the actual line PLINESPACING is not
   adjusted when ACCENTLINE=FALSE because already done with
   procedure YJOB *)

Var PTEMP : PLINESPACING;

BEGIN
   PTEMP := PSPACINGBASE;
   WHILE PTEMP <> NIL DO BEGIN
      WITH PTEMP  DO BEGIN
        IF (PTEMP@<> PLINESPACING) OR ACCENTLINE THEN
        YPASS := YPASS - YFILM;

        PTEMP := NEXT; END;
    END;
 END;


(*********************MAIN YADVANCE_LINESPACING **************)

BEGIN
    IF LINESPACINGJOB THEN BEGIN
```

```
        (* find line spacing element with min-value YPASS *)
        FIND_YMIN (PLINESPACING);
        WHILE YVALUE >= PLINESPACING .YPASS DO BEGIN
           WITH PLINESPACING@ DO BEGIN
              YUNCONDITIONAL  := FILMADVANCEUNCONDITIONAL;
              YJOB (YPASS, YFILM);
              YVALUE := YVALUE - YFILM;
              LINESPACINGADJUST (YFILM, FALSE): (*without actual
                                                  line  *)
              JOBRELOCATING (TEXPOINTER,1,YPASS);
              LINESPACING (PLINESPACING); (*prepare subsequent pass *)
              FIND_YMIN (PLINESPACING);
              IF NOT LINESPACINGJOB THEN EXIT;
           END;
        END;
     END;
     (*film advance without linespacing pass *)
     YUNCONDITIONAL := FALSE;
     YJOB (YVALUE, YFILM);
     LINESPACINGADJUST (YFILM, TRUE);
  END;
```

I claim:

1. A method for imaging a master encoded character, having an encoded character physical baseline and a fixed size, on a display having a fixed size at a pre-determined size larger than said display size in a first dimension, comprising the steps of:

identifying characters for imaging on said display, at a size larger than the said display size and extending beyond the limits of the maximum size of said display in said first dimension, identifying point data at specified locations in the encoded data defining the character relative to the encoded character physical baseline for dividing the encoded character into encoded separate sections, whereby each of said encoded separate sections is to be of a size no greater than said display size in said first dimension when said encoded separate sections are displayed;

identifying a location in said separate encoded sections for inserting an encoded logical baseline and referencing said encoded logical baseline for said encoded separate sections to said encoded character physical baseline, referencing said encoded character physical baseline and said encoded logical baseline to a respective display physical baseline and referencing said respective display physical baseline to its projection in an imaging surface movable relative to said display, and moving said imaging surface to locate the respective logical baselines for said separate encoded sections projected onto said imaging surface in the same relative relationship to the projection of said encoded character physical baseline on said imaging surface as said encoded logical baselines as to said encoded character physical baseline.

2. The method of claim 1, wherein:

the step of moving includes one of the steps of moving said imaging surface in said first dimension an amount related to the relative encoded spacing between a pair of encoded logical baselines and moving said imaging surface an amount related to the relative encoded spacing between an encoded logical baseline and said encoded character physical baseline to offset said encoded sections when projected on said imaging surface at said predetermined size whereby the imaged sections when projected reproduce said character.

3. The method of claim 1, wherein: said step of identifying includes the step of encoding said logical baseline and said character physical baseline in said encoded character.

4. The method of claim 2, wherein: said steps of referencing said respective display physical baselines to its projection on an imaging surface includes grouping encoded separate sections having the same physical baseline locations on said imaging surface, ordering the said group sections relative to the said imaging surface display physical baseline locations of said sections, and projecting said groups of encoded sections according to said ordering.

* * * * *